US007995953B2

(12) United States Patent
Ozerov

(10) Patent No.: US 7,995,953 B2
(45) Date of Patent: Aug. 9, 2011

(54) HIGH SPEED ELECTROGRAPHIC PRINTING

(75) Inventor: Alexander Borisovich Ozerov, Eastwood (AU)

(73) Assignee: Xeikon IP B.V., GZ Eede (NL)

( * ) Notice: Subject to any disclaimer, the term of this patent is extended or adjusted under 35 U.S.C. 154(b) by 553 days.

(21) Appl. No.: 11/991,659

(22) PCT Filed: Sep. 7, 2006

(86) PCT No.: PCT/AU2006/001307

§ 371 (c)(1),
(2), (4) Date: Mar. 7, 2008

(87) PCT Pub. No.: WO2007/028205

PCT Pub. Date: Mar. 15, 2007

(65) Prior Publication Data

US 2009/0052948 A1 Feb. 26, 2009

(30) Foreign Application Priority Data

Sep. 9, 2005 (AU) ..... 2005904960

(51) Int. Cl.
*G03G 15/10* (2006.01)

(52) U.S. Cl. ..... 399/239; 399/57; 399/119

(58) Field of Classification Search ..... 399/53, 399/57, 119, 233, 237–240, 348
See application file for complete search history.

(56) References Cited

U.S. PATENT DOCUMENTS

| | | | | | |
|---|---|---|---|---|---|
| 3,910,231 | A * | 10/1975 | Inoue et al. | ..... | 399/225 |
| 4,395,113 | A * | 7/1983 | Buchan et al. | ..... | 399/348 |
| 5,826,148 | A * | 10/1998 | Iino et al. | ..... | 399/240 |
| 5,987,282 | A * | 11/1999 | Tsukamoto et al. | ..... | 399/237 |
| 6,108,508 | A * | 8/2000 | Takeuchi et al. | ..... | 399/238 |
| 6,163,669 | A * | 12/2000 | Aoki et al. | ..... | 399/159 |
| 6,311,034 | B1 * | 10/2001 | Nakashima et al. | ..... | 399/239 |
| 6,341,204 | B1 * | 1/2002 | Tomiki et al. | ..... | 399/53 |
| 2002/0098016 | A1 * | 7/2002 | Kurotori et al. | ..... | 399/237 |
| 2004/0005407 | A1 * | 1/2004 | Takeuchi et al. | ..... | 427/240 |
| 2004/0009012 | A1 | 1/2004 | Kwak | | |

FOREIGN PATENT DOCUMENTS

| | | |
|---|---|---|
| EP | 0 913 743 | 5/1999 |
| EP | 0 760 494 | 4/2002 |
| WO | WO 02/02663 | 1/2002 |
| WO | WO 2006/047558 | 5/2006 |

* cited by examiner

*Primary Examiner* — David P Porta
*Assistant Examiner* — Benjamin Schmitt
(74) *Attorney, Agent, or Firm* — Klauber & Jackson LLC

(57) ABSTRACT

A high speed electrostatic printing machine has a toner supply of a high viscosity highly concentrated liquid toner to a pick-up roller and then a metering roller. A doctor blade bears against the metering roller which bears against a development member with an interference fit. An image forming stage comprising an image carrying member having a surface adapted to retain an electrostatic latent image thereon with the development member engaging against the image carrying member with an interference fit to give a selected contact time therebetween. Then there is a development stage and a transfer stage. A carrier liquid displacement device acts upon the thin layer of toner on the development member to push toner particles in the thin layer towards the surface of the roller and to leave a carrier liquid rich layer on the outside of the thin toner layer.

56 Claims, 10 Drawing Sheets

HIGH SPEED ELECTROGRAPHIC PRINTING

CROSS REFERENCE TO RELATED APPLICATIONS

The present application is a National Stage Application claiming the priority of co-pending PCT Application No. PCT/AU2006/001307 filed Sep. 7, 2006, which in turn, claims priority from Australian Application Serial No. 2005904960, filed Sep. 9, 2005. Applicants claim the benefits of 35 U.S.C. §120 as to the PCT application and priority under 35 U.S.C. §119 as to the said Australian application, and the entire disclosures of both applications are incorporated herein by reference in their entireties.

FIELD OF INVENTION

This invention relates to electrostatography, and more particularly to a method and means for high speed electrographic printing utilising highly viscous, highly concentrated liquid developers.

BACKGROUND OF THE INVENTION

A non-impact printing process can be simply defined as a process which uses an electronic, electric, magnetic or optical means to produce characters as opposed to a mechanical means. Of the non-impact printing processes, there is a group of printing methods that uses electrostatic techniques. Electrostatic printing can be defined as those methods which use the interaction of electrostatically charged marking particles and an electric field to control the deposition of the marking particles onto a substrate, and encompasses processes generally known as electrographic, electrophotographic, or electrostatographic printing.

Electrostatography can be a term used to describe the various non-impact printing processes which involve the creation of a visible image by the attraction of charged imaging particles or marking particles to charged sites present on a substrate. Such charged sites, forming what is usually termed a latent image, can be transiently supported on photoconductors or pure dielectrics and may be rendered visible in situ or be transferred to another substrate to be developed in that location. Additionally such charged sites may be the reflection of those structured charges existing within a permanently polarised material as in the case with ferroelectrics or other electrets.

In electrostatography the imaging particles, generally known as toner, can be of the dry type or of the liquid type. Dry powder toners have many disadvantages. For example the performance of dry powder toners is very susceptible to environmental conditions, influencing, for example, charge stability, and therefore giving rise to variable image performance. Also, the large particle size of dry powder toners is a major contributing factor in not allowing the achievement of highly resolved developed images.

For high speed, long run printing, cost per page is a principal consideration. In particular, the cost of fusing the image to paper or any other desired substrate significantly contributes to the running costs of such a printer. Other objections are related to the problem of dusting. Dust or fine or small particles of toner are prone to escape from the developer, and these deposit onto any surface both within and outside the printing device, causing mechanical failures within the device and environmental problems outside the device. This problem becomes severe when such dry powder printing devices are run at high speed. In addition, achieving high resolution with dry powder toners at high speed is difficult due to the fact that the dusting problem is further exacerbated by the need to reduce dry toner particle size to a level which will allow acceptable resolution at high speeds, which further compounds the difficulty and dangers in handling such fine powders. Dry powder system therefore can not in practice achieve high resolution images at high speeds, that are usually associated with analogue printing methods such as off-set and gravure printing. Other disadvantages include cost of the general maintenance of the printer and cost of the dry powder toner.

It is known that latent electrostatic images can be developed with marking particles dispersed in insulating or non-polar liquids. Such marking particles normally comprise colouring matter such as pigments which have been ground with or otherwise combined with resins or varnishes or the like. Additionally, charge directing agents are usually included to control the polarity and charge-to-mass ratio of the toner particles. These dispersed materials are known as liquid toners or liquid developers. In use, a liquid developer is applied to the surface of a latent image bearing member to develop an electrostatic image on the member.

Liquid toner development systems are generally capable of very high image resolution because the toner particles can safely be much smaller, normally in the range of 0.5 to 3 μm, than dry toner particles which are normally in the range of 7 to 10 μm. Liquid toner development systems show impressive grey scale image density response to variations in image charge and achieve high levels of overall image density. Additionally, the systems are usually inexpensive to manufacture and are very reliable. Furthermore, the liquid toners for these systems are operationally and chemically stable, particularly to environmental changes due to buffering properties of the carrier liquid, thus exhibiting a particularly long shelf-life.

Liquid developers have generally utilized low viscosity liquids and low concentration of the solids, that is, of marking particles. These traditional toners and associated process systems may be termed low viscosity toner or LVT systems. Generally, LVT systems utilise toners with low viscosities, typically 1 to 3 mPa·s. and low volumes of solids, typically 0.5 to 2% by weight. Maintaining a uniform dispersion of the marking particles can be difficult in a low viscosity toner system. The marking particles have a tendency to drift and settle in the carrier liquid. Furthermore, low volume of solids in the toner increases the amount of toner required to develop a given latent image. More liquid toner will have to be presented to the photoconductor surface in order to provide sufficient marking particles for a desired image density. In order to meet this toner supply demand, LVT printing systems are usually designed to have reasonably large development gaps. Such an arrangement of the development region has several drawbacks, such as a reduced strength and uniformity of the electric field in the development gap, and additional complexity in the design required to maintain a constant gap in the printing direction, as well as across the page. This usually results in reduced development efficiency, edge effects and non-uniform solid fill.

Devices using such liquid electrographic printing can also have some objectionable problems, especially when these devices are required to operate at speeds at or above 0.5 $ms^{-1}$. The main problem is in regard to the solvent carry-out. The term solvent carry-out relates to the quantity of solvent or carrier which is transferred onto and trapped within the paper. Such solvent subsequently evaporates during image fusing, giving rise to atmospheric pollution and also adding significantly to production costs. A further disadvantage of such liquid toning is the tendency for deposition of colouring matter in non-image or background areas which results in a general discolouration of the copy, normally referred to as background staining or fog.

To overcome these and other known problems that can be associated with LVT systems, highly concentrated liquid toner development systems utilising toner with solids concentrations of up to 60% by weight and viscosities of up to 10,000 mPa·s, and utilizing thin films, typically 1 to 40 μm, of the highly concentrated and viscous liquid toner have been disclosed. This system of developing electrostatic latent images with these viscous and highly concentrated liquid toner systems may be termed high viscosity toner or HVT systems. Examples of such liquid toners are disclosed in commonly assigned U.S. Pat. No. 5,612,162 to Lawson et al., and U.S. Pat. No. 6,287,741 to Marko, the disclosures of which are totally incorporated herein by reference. Examples of high viscosity, high concentration liquid developing methods and apparatus are disclosed in commonly assigned U.S. Pat. No. 6,137,976 to Itaya et al. and U.S. Pat. No. 6,167,225 to Sasaki et al., the disclosures of which are totally incorporated herein by reference. These new HVT liquid developing systems overcome many of the short-comings of traditional LVT systems. The term high viscosity is intended to refer to viscosities of the prepared toner of greater than 10 mPa·s., and a solids concentrations of up to 60% by weight.

In the liquid development of electrostatic latent images by LVT systems, the electrostatic latent images formed on the image bearing member are made into visible images by the toner, which consists of charged marking particles in an insulative liquid. Some such LVT systems may use the same carrier medium, as used in the liquid developing agent, to apply a pre-wet liquid on the image bearing member before the actual developing process begins; this is a well known means of preventing the adhesion of toner to the non-image parts of the image bearing member and thereby preventing background staining or fog. In most instances, however, the use of a pre-wet liquid in LVT systems is not required due to the fact that liquid toners used in such systems are of a low solids concentration and of low viscosity.

Traditionally, HVT printing systems have utilised pre-wet mechanisms to minimise background staining or fog, due to the fact that HVT type systems utilise liquid toners of very high solids content and of high viscosity. Various methods have been disclosed which can be used to apply the pre-wet liquid. For example, a roller with depressions and protuberances may be used as the member that supplies the pre-wet liquid. Alternatively, a blade provided with a slit from which pre-wet liquid flows may be used. In this method of applying the pre-wet liquid, the blade is positioned near to the image bearing member such that the pre-wet liquid forms a liquid bank between the image bearing member and the blade. In most instances however, the mechanical application of a pre-wet liquid can be problematic in that it requires high precision in dispensing a small and controlled amount of liquid in order to achieve background fog prevention over the whole printing area. It may therefore be difficult to adequately prevent toner adhesion to the non-image parts on the image bearing member. This problem is further exacerbated at high speeds. Further, the pre-wet liquid may have different physical and or chemical properties to those of the carrier fluid of the liquid toner. In those cases, there can be associated difficulties in recycling the liquid developer contaminated with the pre-wet liquid.

At high speeds, processing parameters and development times become much more critical and special constructions and operational techniques are necessary for good imaging. The HVT systems have been further developed and it is an object of this invention to provide a method and means for high speed electrographic printing utilising highly viscous, highly concentrated liquid developers. Additionally, there is a strong desire for a high speed, highly concentrated liquid toner development system that can operate at high speed whilst achieving high print image density, no background staining or fog, and without the need for the separate mechanical application of a pre-wet to the imaging member prior to latent image development.

It is a further object of this invention to provide a method and means for high speed electrographic printing utilising highly viscous, high solids content liquid developers that achieve highly resolved images at high speeds, that are usually associated with analogue printing methods such as offset and gravure printing.

The term "high speed" as herein used is intended to mean printing speeds of greater than 0.5 $ms^{-1}$.

BRIEF DESCRIPTION OF THE INVENTION

In one form therefore, the invention is said to reside in an electrostatic printing machine adapted for high speed printing comprising;

(a) a toner supply device to supply to a toner supply roller a high viscosity highly concentrated toner;

(b) a metering roller which receives a thin layer of the toner from the toner supply roller;

(c) a development member;

(d) the metering roller bearing against the development member with an interference fit to transfer a thin layer of the toner onto the development member;

(e) an image forming stage, the image forming stage comprising an image carrying member having a surface adapted to retain an electrostatic latent image thereon;

(f) the development member engaging against the image carrying member with an interference fit to give a selected contact time therebetween;

(g) a development stage in which toner particles in the thin layer on the development member are transferred to the image carrying member under the influence of the electrostatic latent image on the image carrying member to provide a developed image thereon; and (h) a transfer stage in which the developed image is transferred from the image carrying member onto a substrate.

As used herein the term "interference fit" means the contact between adjacent members or rollers created by setting a constant distance between shafts of the contacting rollers or members.

Preferably the metering roller comprises a pattern of recesses thereon and further including a doctor blade bearing against the metering roller.

Preferably the electrostatic printing machine can further include a pick-up roller between the toner supply roller and the metering roller and which is spaced from the supply roller by a first feed gap and spaced from the metering roller by a second feed gap.

Preferably the high viscosity toner comprises a concentration of chargeable marking particles of up to 60% by weight in a non-conductive carrier liquid, more preferably the high viscosity toner comprises a concentration of chargeable particles of from 5 to 40% by weight.

Preferably the high viscosity toner exhibits a viscosity of 10 mPa·s to 10,000 mPa·s, more preferably the toner exhibits a viscosity of 10 mPa·s to 5,000 mPa·s., even more preferably the toner exhibits a viscosity of 20 mPa·s to 1,000 mPa·s.

Preferably the first feed gap between the toner supply roller and the pick-up roller is from 100 to 500 μm and the second feed gap between the pick-up roller and the metering roller is from 50 to 400 μm.

There can be further included a feeder roller between the metering roller and the development member, the feeder roller being driven to rotate at a speed and or direction which is different to the speed and or direction of the development member.

In one embodiment the image forming stage comprises an image carrying member having a surface adapted to retain an electrostatic charge thereon, a charging device to provide a uniform electrostatic charge to the surface and a discharge device to selectively discharge the uniform electrostatic charge to form the electrostatic latent image thereon. The surface of the image carrying member can comprise a photoconductor and the discharge device can comprise an illumination device.

Alternatively, the image forming stage comprises an image carrying member having a dielectric surface adapted to retain an electrostatic charge thereon and a selective charging device to provide a selected electrostatic charge to the surface to form the electrostatic latent image thereon.

Preferably the toner supply comprises a pair of counter rotating gears feeding the high viscosity toner to the toner supply roller.

Other means of toner supply may be utilised, for example a slit coating chamber mechanism delivering the toner through the slit directly onto the surface of a roller.

Preferably the pick-up roller is a metal roller. The pick-up roller may also comprise an elastomer coated roller with polyurethane or NBR or other suitable material.

There may be provided a doctor blade bearing against the pick-up roller to provide a layer of the high viscosity toner on the pick-up roller of from 100 to 2000 μm thick.

The primary purpose of the pick-up roller is to limit and control the amount of toner that is delivered onto the surface of the metering roller, particularly at the increased toner supply rates associated with high speed printing.

In an alternative embodiment the pick-up roller may be excluded and the toner is supplied directly onto the metering roller by a toner supply mechanism.

Preferably the patterned metering roller comprises an Anilox roller. The pattern on the Anilox roller may be selected from trihelical and Z-channel and may have a line resolution of from 150 to 300 lines per inch and a pattern depth of from 20 to 40 μm. Preferably the Anilox roller has a trihelical pattern configuration, a resolution of 200 lines per inch and a pattern depth of 30 μm. Other Anilox type patterns however may also be used on the metering roller, and including random patterns.

The development member may be held at an electrical potential of from +50 to +800 volts.

The interference fit of the metering roller against the development member may be from 50 to 2000 μm. The interference fit of the development member against the image carrying member may be from 50 to 2000 μm.

There may be further provided a carrier liquid displacement device to act upon the thin layer of liquid toner on the development member. The carrier liquid displacement device may take various forms, including the form of a corona generating device or the like, or it may take the form of a roller type mechanism. The carrier liquid displacement device is placed in a position adjacent to the development member, and a corona producing voltage, in the case where a corona generating device is used, is applied to establish an electric field across the toner layer and through electrophoretic movement of the charged toner particles create a spatial separation of the toner particles and the carrier liquid within the toner deposit, whereby the carrier liquid is displaced to the surface of the toner layer, and therefore, if required, acts as a pre-wet layer. Another effect of the carrier liquid displacement device is to adjust or reinforce the charge on the individual toner particles and provide additional particle compaction for enhanced density uniformity of the developed image. Such toner material of accurately controlled polarity and density when presented to the latent image allows for the development of images to very uniform density and devoid of background stain, without the need for any form of additional pre-wet system.

Hence in one embodiment the carrier liquid displacement device comprises a corona discharge device. The voltage applied to the corona discharge device being of a sufficient order to create a corona discharge, and this may be up to several thousand volts of the appropriate polarity. Alternatively, the carrier liquid displacement device comprises a roller type mechanism bearing with an interference fit against the development member and having a voltage applied to it of from +50 to +1500 volts. The carrier liquid displacement roller bearing against the development member may have a smooth surface finish or it may have a patterned surface, and in one embodiment, the carrier liquid displacement roller may be an Anilox type roller. The carrier liquid displacement roller bearing against the development member can also be adapted to simultaneously remove excess carrier from the development member, whereby the excess liquid can be scraped off the carrier liquid displacement roller by a scraper blade positioned against the roller.

The development stage may comprise discharged area development (DAD) or charged area development (CAD).

In one embodiment, the electrostatic image on the image carrying member may have non-image regions at a potential of from +200 to +900 volts and image regions at a potential of from +0 to +150 volts.

There may be further provided an intermediate transfer stage in which the developed image is transferred from the image carrying member to an intermediate transfer member before being transferred to the substrate. The final transfer stage would then comprise the developed image being transferred from the image carrying member to the intermediate transfer member and then from the intermediate transfer member onto the substrate.

There may be an interference fit between the image carrying member and the intermediate transfer member to give a selected contact time therebetween. The interference fit of the image carrying member against the intermediate transfer member may be from 50 to 2000 μm.

The intermediate transfer member may be held at an electrical potential of from −50 to −2000 volts.

There may be further provided an erasing stage in which any remaining electrostatic image on the image carrying member is erased.

There may be further provided a cleaner stage in which any unused toner on the development member after the selective transfer to the image carrying member is cleaned off the development member. This unused toner may be recycled to a toner supply or to a recycling and replenishment system.

There may be further provided a cleaner stage in which any residual toner on the image carrying member after the transfer to the final transfer stage is cleaned off the image carrying member.

There may be further provided a cleaner stage in which any residual toner on the intermediate transfer member after the transfer to the final transfer stage is cleaned off the intermediate transfer member.

Each of the cleaner stages can comprise a cleaning brush roller and a smooth elastomer cleaning blade each side of the brush roller engaged against the image carrying member or the intermediate transfer member.

Alternatively each of the cleaner stages can comprise a smooth surfaced cleaning roller and a smooth elastomer cleaning blade engaged against the image carrying member or the intermediate transfer member.

The cleaner roller can comprise a roller selected from the group comprising an elastomer coated roller or a highly polished metal roller.

The cleaner stage can further comprises a flush fluid supply to lubricate the cleaning roller and cleaning blade and to dilute cleaner residue for ease of recycling.

There may be further provided an image fixing stage in which the image on the substrate is fixed. Preferably the image fixing stage uses heat and compression between rollers. Alternatively, the image fixing stage uses non-contact methods such as IR, UV and EB curing or other known methods of image fusing.

The development member, the pick-up roller, the metering roller and the toner supply roller may be held at the same voltage. There may be further provided a voltage differential between the rollers to enhance selective transfer of the toner particles and or to enable the change in the toner splitting ratio between the rollers, hence allowing the adjustment of the toner layer thickness on the development member.

Preferably the image carrying member is a drum with a photoconductive surface selected from the group comprising α-silicon, organic photoconductor or $As_2Se_3$.

Preferably the development member is selected from the group comprising a roller or a belt.

There may be further provided a pressure roller behind the substrate at the final transfer stage.

Preferably there can be provided a set screw arrangement or a cam mechanism engaging a shaft of the metering roller to engage the metering roller against the development member to set the amount of the interference fit.

The substrate may be selected from the group comprising of sheet fed substrates or a continuous web. The substrate may comprise paper or other printable surface such as for example plastic films, metal, and other such materials.

Preferably the toner is formed by dispersing marking particles in a dielectric liquid such that the liquid developing agent has a viscosity of up to 10,000 mPa·s., even more preferably, the toner exhibits a viscosity of 20 mPa·s to 1,000 mPa·s.

The thin layer of the toner transferred onto the development member may have a thickness of from 1 to 40 μm.

In an alternative embodiment, the invention is said to reside in an electrostatic printing machine adapted for high speed printing comprising;

a) a toner supply to supply to a supply roller a high viscosity toner having a concentration of chargeable particles of up to 60% by weight in a non-conductive carrier liquid;

b) a pick-up roller which is spaced from the supply roller;

c) a first feed gap between the toner supply roller and the pick-up roller of from 100 to 500 μm;

d) a metering roller which receives a layer of the toner from the pick-up roller;

e) a second feed gap between the pick-up roller and the metering roller of from 50 to 400 μm;

f) the metering roller having a pattern of recesses thereon;

g) a doctor blade bearing against the metering roller;

h) a feeder roller which receives a layer of the toner from the metering roller;

i) the metering roller bearing against the feeder roller with an interference fit;

j) a development member;

k) the feeder roller bearing against the development member with an interference fit to transfer a thin layer of the toner onto the development member;

l) an image forming stage, the image forming stage comprising an image carrying member having a surface adapted to retain an electrostatic charge thereon, a charging device to provide a uniform electrostatic charge to the surface and a discharge device to selectively discharge the uniform electrostatic charge to form an electrostatic image thereon;

m) the development member engaging against the image carrying member with an interference fit to give a selected contact time;

n) a development stage in which toner particles in the thin layer on the development member are transferred to the image carrying member under the influence of the electrostatic image on the image carrying member to provide a developed image thereon; and o) a transfer stage in which the developed image is transferred from the image carrying member onto a substrate, or a further member, such as an intermediate member.

The feeder roller bearing against the development member can be adapted to rotate at a differential speed to the development member such as rotating at a different speed in the same direction or counter-rotating.

In an alternative embodiment, the invention is said to reside in an electrostatic printing machine adapted for high speed printing comprising;

(a) a toner supply to supply to a toner supply roller a high viscosity highly concentrated toner;

(b) a pick-up roller which is spaced from the supply roller by a first feed gap, wherein the first feed gap between the toner supply roller and the pick-up roller is from 100 to 500 μm;

(c) a metering roller which receives a thin layer of the toner from the pick-up roller, wherein a second feed gap between the pick-up roller and the metering roller is from 50 to 400 μm;

(d) the metering roller having a pattern of recesses thereon;

(e) a doctor blade bearing against the metering roller;

(f) a development member;

(g) the metering roller bearing against the development member with an interference fit to transfer a thin layer of the toner onto the development member, wherein the interference fit of the metering roller against the development member is from 50 to 2000 μm;

(h) a carrier liquid displacement device to act upon the thin layer of toner on the development member to push toner particles in the thin layer towards the surface of the roller and to leave a carrier liquid rich layer on the outside of the thin toner layer;

(i) an image forming stage, the image forming stage comprising an image carrying member having a surface adapted to retain an electrostatic latent image thereon;

(j) the development member engaging against the image carrying member with an interference fit to give a selected contact time therebetween;

(k) a development stage in which toner particles in the thin layer on the development member are transferred to the image carrying member under the influence of the electrostatic latent image on the image carrying member to provide a developed image thereon;

(l) an intermediate transfer stage in which the developed image is transferred from the image carrying member to an intermediate transfer member with an interference fit between the image carrying member and the intermediate transfer member to give a selected contact time therebetween; wherein the interference fit of the image carrying member against the intermediate transfer member is from 50 to 2000 μm; and (m) a transfer stage in which the developed image is transferred from the intermediate transfer member onto a substrate.

In a further form the invention may be said to reside in a method of high speed toning comprising the steps of;

(a) forming an electrostatic latent image on an image carrying member;

(b) forming a film of a toner on the surface of a development member, the toner having a viscosity of up to 10,000 mPa·s, and a concentration of chargeable particles of up to 60% by weight in a non-conductive carrier liquid;

(c) imposing an electric field through the film of toner on the surface of the development member, thus forming a potential difference though the toner layer, whereby the film of toner splits into two spatially separated layers; one layer comprising an increased concentration of toner particles compacted close to the development member, and a second layer of carrier fluid positioned above the compacted toner layer, and substantially free from toner particles;

(d) bringing the development member with the spatially separated layers of liquid developing agent in contact with the image carrying member such that the second layer of carrier fluid positioned above the compacted toner layer acts as a pre-wet film on the surface of the image bearing member prior to the compacted toner layer developing the latent image, thereby fully developing the latent image on the image carrying member, without any background staining or fog;

(e) transferring the developed image from the image carrying member onto a further member or a final substrate; and (f) fixing the transferred image on the final substrate.

The step of bringing the development member with the spatially separated layers of liquid developing agent in contact with the image carrying member can include holding the development member in contact with the image carrying member for a selected period of time by providing an interference fit between the development member and the image carrying member.

The step of imposing an electric field through the film of toner on the surface of the development member can be accomplished using a carrier liquid displacement device.

Alternatively, the step of imposing an electric field through the film of toner on the surface of the development member can be done using a corona discharge device.

Alternatively, the step of imposing an electric field through the film of toner on the surface of the development member can be done using a carrier liquid displacement roller bearing against the development member and having a voltage applied to it of from +50 to +1500 volts.

The development member can have the following range of characteristics:

| | |
|---|---|
| Roughness: | Rz ≦ 2 μm |
| Hardness of coating: | 40-60° Shore A and more preferably 50° Shore A |
| Surface energy: | 30-40 mN/m and more preferably 35 mN/m |
| Electrical resistivity: | $1 \times 10^4$-$1 \times 10^8$ Ω · cm and more preferably $1 \times 10^6$ Ω · cm |

The intermediate member can have the following range of characteristics:

| | |
|---|---|
| Roughness: | Rz ≦ 2 μm |
| Hardness of coating: | 40-70° Shore A and more preferably 60° Shore A |
| Surface energy: | 20-40 mN/m and more preferably 25 mN/m |
| Electrical resistivity: | $1 \times 10^4$-$1 \times 10^8$ Ω · cm and more preferably $1 \times 10^7$ Ω · cm. |

It has been found that an important factor in high speed HVT printing is to enable sufficient time for the development and transfer of the developed images.

This time factor, for a given high speed system, is determined by roller diameters, print speed and the interference fit. Hence for the present invention there is a defined interference fit between the metering roller and the development member and between the development member and the imaging member.

In contrast, in a traditional resilient type of contact, what is being primarily controlled is the contact force. The development system of the present invention is not dependent on the force between the rollers, but strictly on the nip width. Also, having an interference fit in an HVT high speed print engine provides stable printing and prevent vibration of the rollers that could be originate from a resilient engagement. This can in fact lead, for example, to banding on the developed image due to the instability of the rollers caused by the resilient urging. Finally, a further advantage is that it is simpler to create a controlled contact between rollers by adjusting distances, rather than changing the force between the rollers.

BRIEF DESCRIPTION OF THE DRAWINGS

This then generally describes the invention, but to assist with understanding reference will now be made to the accompanying drawings which show a preferred embodiment of the invention.

DETAILED DESCRIPTION OF THE INVENTION

Figure 1:
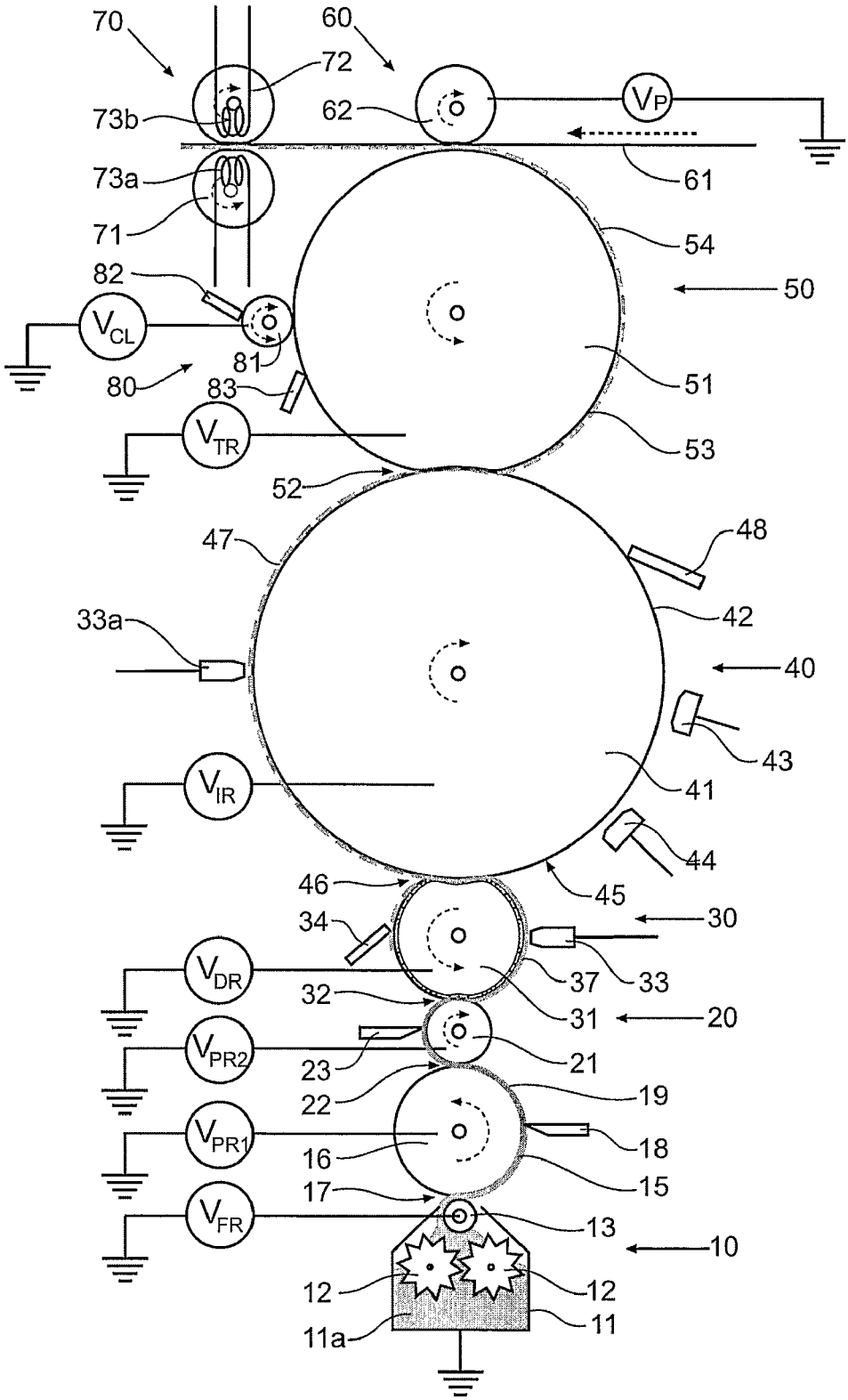
FIG. 1 shows a schematic representation of a high speed electrostatic printing apparatus according to the present invention.

Now looking at FIG. 1, this drawing shows a schematic electrostatic printing apparatus according to the present invention and particularly shows a schematic toner travel path.

In FIG. 1, the schematic electrostatic printing process generally has a toner supply stage 10, a toner metering apparatus 20, a development stage 30, an imaging stage 40, an intermediate transfer stage 50, a transfer to substrate stage 60, a fixing stage 70 and a cleaner stage 80.

In the toner supply stage 10 a toner tank 11 has counter rotating gear wheels 12 which extend into toner 11*a* in the tank 11 and provide a supply of high viscosity toner to a supply roller 13. The supply roller extends out of the top of the toner tank 11 and is spaced apart from a pick-up roller 16 by a gap 17 which is in the range of from 100 to 500 μm. This produces a layer of toner on the pick-up roller of at least 100 μm. The toner supply stage may comprise other forms or methods of supplying, pumping or otherwise moving the toner from toner tank 11 to pick-up roller 16.

The pick-up roller 16 has a doctor blade 18 bearing against it to provide an even thin layer of high viscosity toner on the pick-up roller 16.

The pick-up roller 16 is spaced apart from a metering roller 21 by a gap 22 which is in the range of from 50 to 400 μm. The metering roller 21 has a pattern of recesses on its surface and a doctor blade 23 bearing against the metering roller 21 scrapes essentially all of the high viscosity toner off the metering roller 21 except that toner which is within the recesses in the pattern of recesses on the metering roller 21.

In one preferred embodiment the metering roller preferably has a trihelical pattern with a resolution of 200 lines per inch with a normal pattern depth of 30 μm.

Alternatively, a thin controlled layer of high viscosity high solids content toner can be delivered by the use of a feeder roller system which comprises a roller train comprising a number of smooth rollers. Hence the term metering roller is also intended to include a train of smooth rollers to produce a thin layer (1 to 40 μm) of toner for transfer to the development member.

The metering roller 21 bears against a development member 31 with an interference fit 32 which is within the range of 50 to 2000 μm. The interference fit is made possible because although the surface of the metering roller 21 is relatively hard, the surface of the development member 31 is relatively soft and the metering roller 21 pushes into the development member 31. The interference fit provides a contact time during the rotation of each roller during which toner may be transferred from the metering roller 21 to the development member 31. The thickness of toner on the development member 31 after it has been transferred from the metering roller 21 is in the range of from 1 to 40 μm.

A carrier liquid displacement device 33 acts upon the thin layer of toner 37 on the development member. In this embodiment a corona generating wire is placed in a position adjacent to the development member, and a corona producing voltage is applied which can be used to adjust or reinforce the charge on the individual toner particles or change their location within the toner deposit. Device 33 acts upon the thin layer of toner on the development member to push toner particles in the thin layer towards the surface of the roller and to leave a carrier rich layer on the outside of the thin toner layer. The charge on the carrier liquid displacement device may be the same as that on the toner particles in the highly viscous toner. The corona generating wire or the like, may be placed at a distance of 3-7 mm from the thin layer of toner 37 on the development member 31, preferably about 4 mm, and a corona producing voltage is applied to the wire of about 4-6 kV, preferably 5 kV.

A cleaner device 34 also acts against the development member 31 to clean toner off the developing roller after the development stage as discussed below.

The imaging carrying member in the imaging stage 40 is an imaging roller 41 which has a surface 42 which will carry an electrostatic charge thereon. A charging device 43 provides an even electrostatic charge on the surface 42 of the imaging roller 41 and then a selective discharge device 44 discharges the electrostatic charge so that the surface 42 then has an electrostatic image thereon in the region generally shown as 45. The image carrying member can have a surface 42 which is a dielectric in which case the charging device 43 is a corona discharge device, a charging roller or the like, and the selective discharge device 44 may be an ion gun, for instance. Alternatively, the image carrying member may have a surface 42 which is a photoconductor in which case the charging device 43 is a corona discharge device, a charging roller or the like, and the selective discharge device 44 may be a laser or LED device, for instance. Alternatively, the image carrying member may have a surface 42 which is a permanently polarised material as in the case with ferroelectrics or other electrets.

The development member 31 bears against the imaging roller 41 with an interference fit 46 which may be in the range of 50 to 2000 μm.

The imaging roller 41 has a relatively hard surface and the development member 31 has a relatively soft surface so that the imaging roller pushes slightly into the development member 31. This gives an interference fit and hence a residence or increased contact time between the rollers during which time the electrostatic image is developed by marking particles in the thin layer of toner being attracted to the electrostatic image to give a developed toner image.

Alternatively, the image carrying member may be an imaging belt, which has a surface that carries an electrostatic charge thereon. In this configuration, the imaging belt is held against the development member and the intermediate transfer roller by means of two pressure rollers which engage against the rear side of the imaging belt at the respective contact regions.

The developed toner image is then carried around on the surface 42 of the imaging roller 41 and passes under carrier liquid displacement device 33*a*. The carrier liquid displacement device in this embodiment is illustrated as a corona discharge device. This acts to push toner down to the surface 42 of the imaging roller 41 so that it is compacted before it is transferred at the intermediate transfer stage 50.

The compacted developed toner image 47 is then carried around on the surface 42 of the imaging roller 41 until the intermediate transfer roller 51 is reached. The intermediate transfer roller 51 engages against the imaging roller 41 with an interference fit 52. Again, the interference fit between the imaging roller 41 and the intermediate transfer roller 51 provides a contact time in which toner particles of the developed toner image are transferred to the intermediate transfer roller 51 under the influence of an electric field. The interference fit of the imaging roller against the intermediate transfer roller 51 may be from 50 to 2000 μm. The developed toner image on the surface 42 of the imaging roller 41 is hence transferred to the surface 53 of the intermediate transfer roller 51 and carried around to the final transfer stage 60.

After the developed toner image on the surface 42 of the imaging roller 41 has been transferred to the intermediate transfer roller 51 a cleaner arrangement 48 shown schematically is used to remove excess toner from the imaging roller before it is recharged.

In the final transfer stage 60, the developed toner image is transferred from the intermediate transfer roller 51 to a substrate 61 which is held against the intermediate transfer member 51 by means of a pressure roller 62 which engages against the rear side of the substrate 61. It should be understood that transfer may be of the electrostatic type, pressure type, transfix type, combinations thereof, or other known methods and techniques of transferring and fusing toner images. The substrate 61 may be a continuous web or individuals sheets of paper or other material.

After the developed toner image has been transferred to the substrate 61, it is carried on the substrate and additionally, if required, the substrate passes between a pair of heated rollers 71 and 72 in the fixing stage 70, and the toner is fixed permanently onto the substrate. The heated rollers 71 and 72 have heater elements 73*a* and 73*b* to provide heat to fix the toner onto the substrate.

In the cleaner stage 80 for the intermediate transfer member 51 a cleaner roller 81 bears against the surface 53 of the intermediate transfer member 51. The cleaner roller 81 has a voltage impressed upon it which is different to that on the intermediate transfer member 51 so that toner particles are attracted to the cleaner roller 81 and then removed from that roller by a cleaner blade 82. The cleaner roller 81 can be adapted to rotate at a differential speed to the intermediate transfer member 51, such as rotating at a different speed in the same direction or counter-rotating. After the cleaner roller 81, a cleaner blade 83 is also used to ensure thorough cleaning of the intermediate transfer roller 51.

It has been surprisingly found that if cleaner roller 81 is used to remove a significant amount of any residual material from intermediate transfer member 51, cleaner blade 83 exhibits an exceptionally long life within the apparatus. Such a roller followed by a blade mechanism significantly reduces the cost associated with cleaner blade replacement in a high speed printing apparatus.

The toner travel path for this embodiment of the invention is shown on FIG. 1 by means of a shaded line. The gear wheels 12 feed toner from the tank 11 to the supply roller 13 upon which it is carried to the pick-up roller 16 and then carried on the pick-up roller 16 in an anti-clockwise direction past doctor blade 18 until it reaches the metering roller 21. It is then transferred to the metering roller 21 which rotates in a clockwise direction and the doctor blade 23 on the metering roller 21 again reduces the thickness of toner. The toner is carried in a clockwise direction on the metering roller 21 to the development member 31 where it transfers to the development member during the residence time provided by the interference fit between the metering roller and the development member, as discussed above, to give a thin layer of liquid toner on the development member 31.

The thin layer of liquid toner is then carried in an anti-clockwise direction on the development member past the carrier liquid displacement corona 33, as discussed earlier, until it reaches the imaging roller 41. At this stage, some of the toner particles are transferred in an image-wise manner to the imaging roller 41, but not all is transferred and hence, some toner continues on around the development member 31 to the cleaner 34. The transferred toner 47 is carried in a clockwise direction around the imaging roller 41 past the carrier liquid displacement corona 33*a*, as discussed earlier, to the intermediate transfer roller 51 where the toner 54 is transferred to the intermediate transfer roller 51 and is carried in an anti-clockwise direction on the intermediate transfer roller 51 until it reaches the substrate 61. The toner is then transferred to the substrate 61 and proceeds to the fixing station 70 as discussed above. Any remaining toner on the intermediate transfer roller is cleaned off by cleaner arrangement generally shown as 80 which includes a cleaner roller 81 and a scraper 82 on the cleaner roller, and a further cleaning blade 83 bearing against intermediate transfer roller 51.

Figure 2:
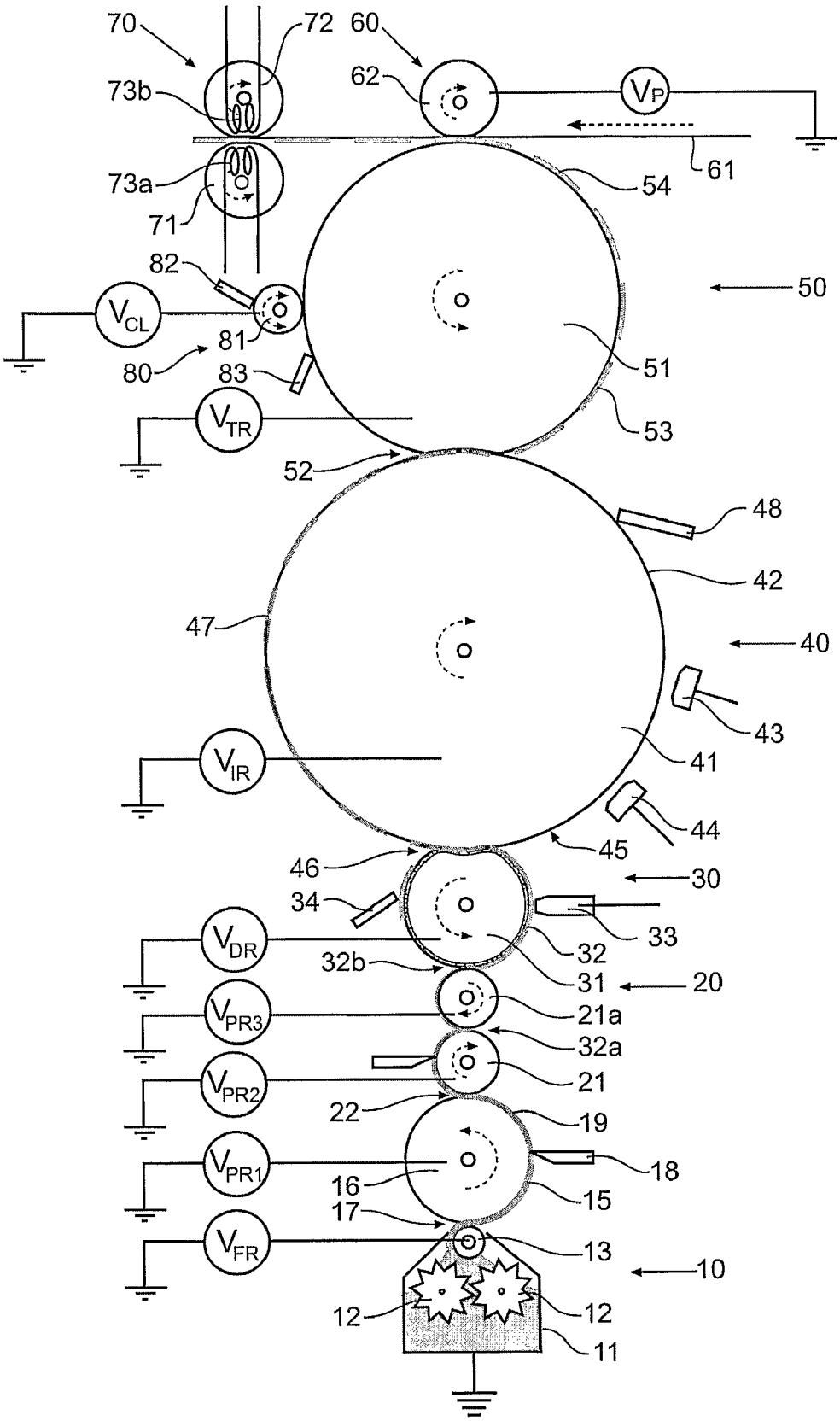
FIG. 2 shows a schematic representation of an alternative high speed electrostatic printing apparatus according to the present invention.

FIG. 2 is an alternative embodiment of the present invention. In FIG. 2, the schematic electrostatic printing process is generally as described in FIG. 1 and the same reference numerals are used for corresponding items.

The toner feed stage 20 in this embodiment has an additional feeder roller 21*a*. The metering roller 21 bears against the feeder roller 21*a* with an interference fit 32*a* which is within the range of 50 to 2000 μm. The interference fit is made possible because although the surface of the metering roller 21 is relatively hard, the surface of the third roller 21*a* is relatively soft and the metering roller 21 pushes into the third roller 21*a*. The interference fit provides a contact time during the rotation during which toner may be transferred from the metering roller 21 to the feeder roller 21*a*. The thickness of toner on the feeder roller 21*a* after it has been transferred from the metering roller 21 is in the range of from 1 to 40 μm.

The third roller 21*a* bears against a development member 31 with an interference fit 32*b* which is within the range of 50 to 2000 μm. The feeder roller 21*a* pushes into the development member 31. The interference fit provides a contact time during the rotation during which toner may be transferred from the feeder roller 21*a* to the development member 31. The thickness of toner on the development member 31 after it has been transferred from the feeder roller 21*a* is in the range of from 1 to 40 μm. In this embodiment, the feeder roller 21*a* rotates at a different surface speed against the development member 31. The surface speed differential transfers toner by the process of welling the toner in transfer gap 32*b*. Also, due to the differential surface speeds between the metering roller 21 and the feeder roller 21*a*, any existing pattern on the toner surface that may have been created by the pattern on the metering roller 21 is destroyed. It has been found that the use of a feeder roller 21*a* differentially rotating against the development member 31 also assists in eliminating rivulet patterns on the developed image. Rivulets are manifest as disruptive localised areas of the continuous image and are similar to patterns observed when a high viscosity material is applied to flat surfaces as a thin film by means of a roller applicator. The differential rotation may be counter rotating or rotating in the same direction but at a different speed.

The step of toner conditioning by device 33 of the thin layer of toner on the development member, and other following process steps are as described for FIG. 1.

Figure 3:
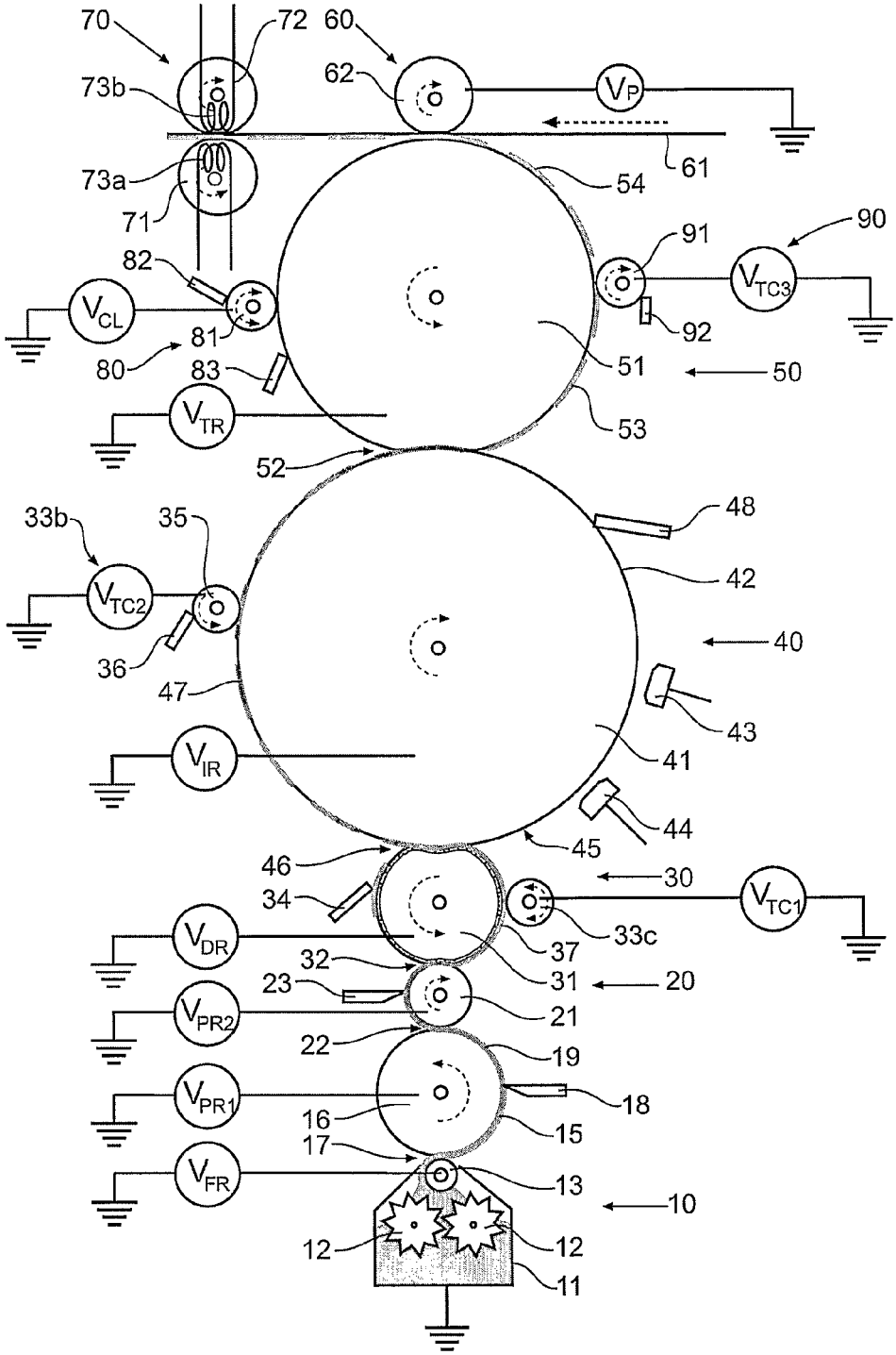
FIG. 3 shows a schematic representation of an alternative high speed electrostatic printing apparatus according to the present invention.

FIG. 3 is an alternative embodiment of the present invention. In FIG. 3, the schematic electrostatic printing process is generally as described in FIG. 1 and the same reference numerals are used for corresponding items.

In this embodiment as the developed toner image is carried around on the surface 42 of the imaging roller 41 it passes under a carrier liquid displacement stage 33*b*. The carrier liquid displacement device in this embodiment is a roller 35 with a voltage $V_{TC2}$ impressed upon it. This acts to push toner down to the surface 42 of the imaging roller 41 so that it is compacted before it is transferred at the intermediate transfer stage 50. At the same time a layer of carrier liquid is formed outside the toner layer as will be discussed in relation to FIG. 10. The roller 35 also acts to remove this excess carrier liquid from the layer of carrier liquid, and the excess liquid is scraped off the roller 35 by scraper 36 and can be recycled. The carrier liquid displacement roller 35 can be adapted to rotate at a differential speed and direction to the imaging roller 41. The carrier liquid displacement roller gap or contact may be adjustable against the imaging roller; preferably, a light or "kiss" type contact has been found to be the most effective across a wide range of conditions.

In this embodiment also the carrier liquid displacement stage on the development member uses a roller 33*c* with a voltage $V_{TC1}$ impressed upon it.

This acts to push toner 37 down to the surface of the development member 31 so that it is compressed before it is used to develop the latent electrostatic image. At the same time a layer of carrier liquid is formed outside the toner layer as will be discussed in relation to FIG. 10. The roller 33*c* also acts to remove excess carrier liquid from the layer of carrier liquid and this excess liquid may be scraped off the roller 33*c* and can be recycled (not shown). The carrier liquid displacement roller 33*c* bearing against the development member 31 may have a smooth surface finish or it may have a patterned surface, and in one embodiment, the carrier liquid displacement roller may be an Anilox type roller. The choice of surface finish can be dependent on the chemistry of the liquid toner, the viscosity and the solids content concentration. In general it has been found that for toner viscosities under 100 mPa·s, a smooth roller can be used, and for toner viscosities above 100 mPa·s, a patterned roller can be preferable. A patterned or a smooth carrier liquid displacement roller can, however, be used within the total viscosity range useable within a HVT type system, and the use of a patterned or a smooth carrier liquid displacement roller can be dependent on not only the viscosity, but also the liquid toner chemistry, physical properties and other characteristics. The patterned roller may take the form of a wire wound roller, a randomly patterned roller or it may take the form of an Anilox type roller. The Anilox roller may have a tri-helical pattern with a resolution of 200 lines per inch with a normal pattern depth of 30 μm. The carrier liquid displacement roller gap or contact may be adjustable against the development member; preferably, a light or "kiss" type contact has been found to be the most effective across a wide range of conditions. It has been surprisingly found that a patterned carrier liquid displacement roller can significantly improve the smoothness of the thin toner layer on the development member. It has been found that the use for example, of an Anilox type roller as a carrier liquid displacement roller can totally eliminate the occurrence of rivulets on the thin layer of liquid toner on the development member, thus allowing the presentation of an extremely even and smooth liquid toner film to the electrostatic latent image resulting in very uniformly developed toner images. The carrier liquid displacement roller can be of a diameter commensurate with the size requirements of the apparatus, and in the present embodiment.

Also in this embodiment, as the developed toner image is carried around on the surface 53 of the intermediate transfer roller 51 it passes under a carrier liquid displacement stage 90. The carrier liquid displacement device in this embodiment is a roller 91 with a voltage $V_{TC3}$ impressed upon it. This acts to push toner down to the surface 53 of the intermediate transfer roller 51 so that it is further compacted before it is transferred to the substrate stage 60. At the same time a further layer of carrier liquid is formed outside the toner layer as will be discussed in relation to FIG. 10. The roller 91 also acts to remove this excess carrier liquid from the layer of carrier liquid, and the excess liquid is scraped off the roller 91 by scraper 92 and can be recycled. The carrier liquid displacement roller gap or contact may be adjustable against the intermediate transfer roller; preferably, a light or "kiss" type contact has been found to be the most effective across a wide range of conditions.

Figure 4:
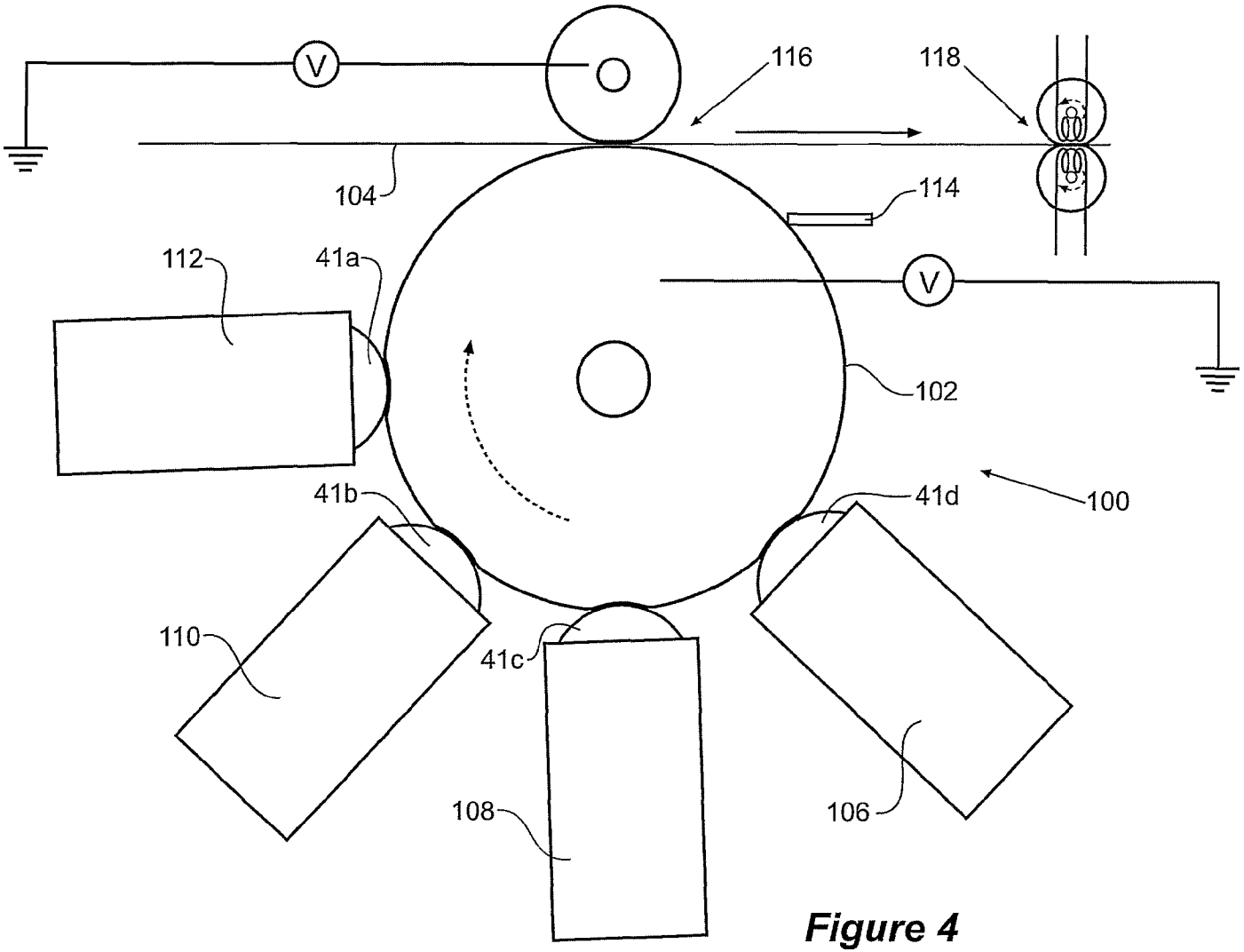
FIG. 4 shows one embodiment of a multi-colour printing apparatus incorporating high speed electrostatic printing stages according to the present invention.
Figure 5:
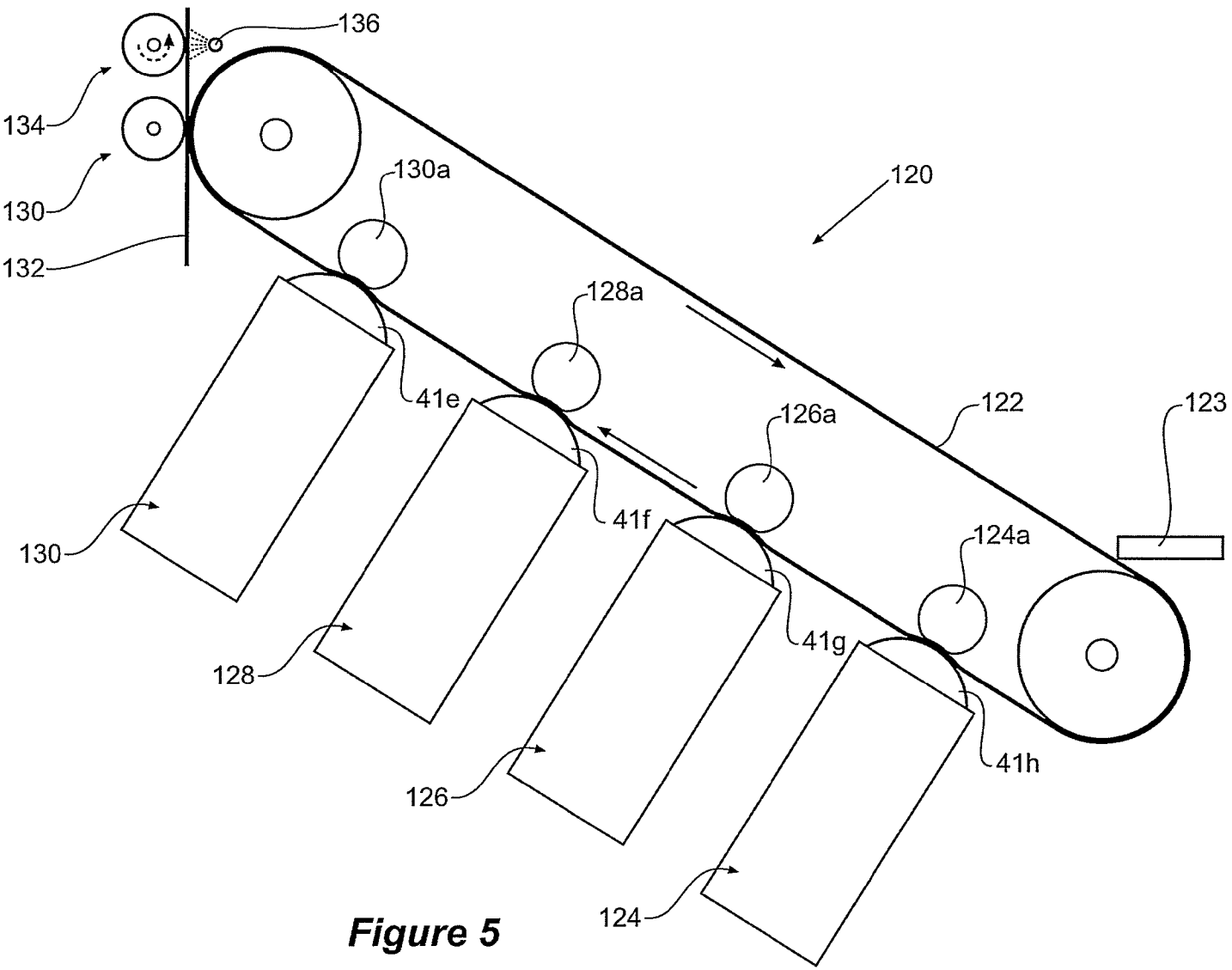
FIG. 5 shows an alternative embodiment of a multi-colour printing apparatus incorporating high speed electrostatic printing stages according to the present invention.
Figure 6:
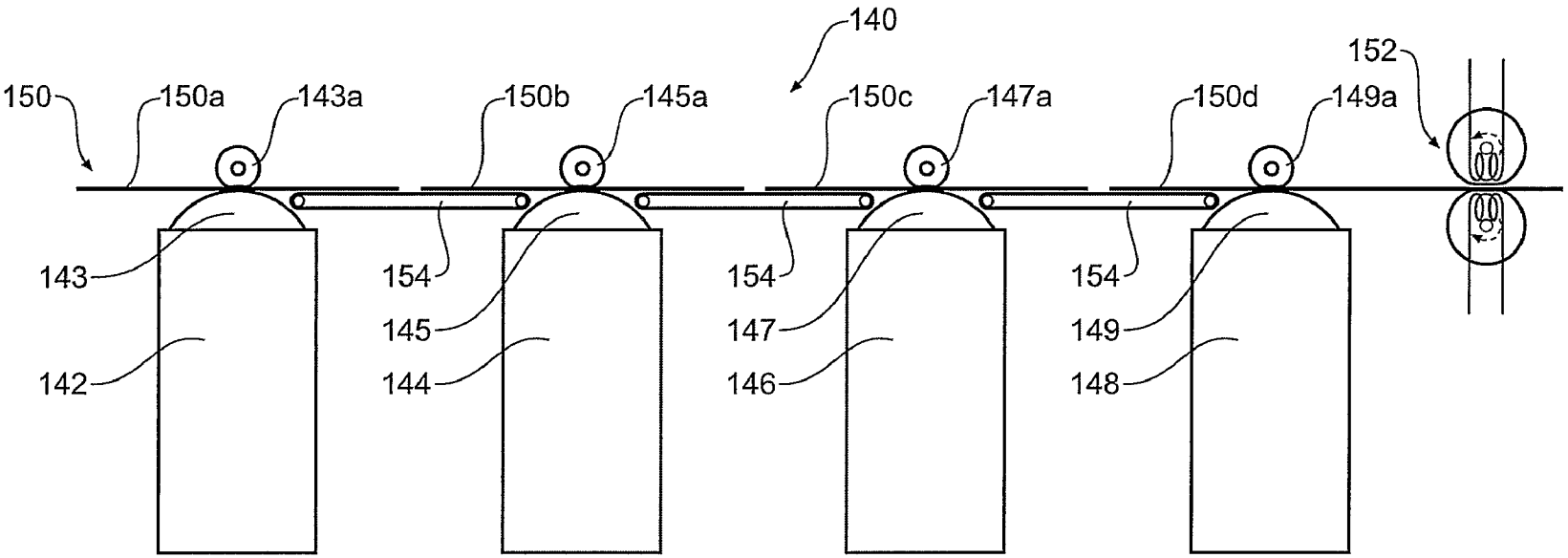
FIG. 6 shows a further alternative embodiment of a multi-colour printing apparatus incorporating high speed electrostatic printing stages according to the present invention.

FIGS. 4, 5 and 6 show various arrangements for multi-colour electrostatic printing.

In FIG. 4, a colour printing arrangement 100 consists of a single intermediate transfer drum 102 upon which four colours, or more if required, are sequentially placed to provide a colour image which is subsequently transferred to a substrate 104. Each of the printing stages 106, 108, 110 and 112 can be any of the embodiments shown in FIGS. 1 to 3. A first printing stage 106 provides a first colour, a second colour printing stage 108 provides a second colour, a third printing stage 110 provides a third colour and a fourth printing stage 112 provides a fourth colour for the image being built up on the surface of the intermediate transfer roller 102. In each printing stage 106, 108, 110 and 112 the imaging roller 41*a*, 41*b*, 41*c* and 41*d* respectively engages against the single intermediate transfer drum 102 with an interference fit. The multi colour image is then transferred to the final substrate and the cleaner 114 cleans the intermediate transfer roller 102 before another image is built up on the intermediate transfer roller 102.

Each of the colour imaging stations 106, 108, 110 and 112 operates in a manner as discussed in relation to the embodiments shown in FIGS. 1 to 3 up to the imaging stage 40 (FIG. 1) and then all of the separate colour images are transferred to the single image transfer roller 102. The final transfer station 116 and the fixing station 118 operate in a similar manner to the respective stages 60 and 70 as shown in FIG. 1.

FIG. 5 shows an alternative arrangement of a multi-colour printing apparatus. In this embodiment the multi colour printing apparatus 120 uses a belt 122 as the intermediate transfer member. The belt may be an elastomeric material, or other suitable transfer material as known in the art. Colour imaging stations 124, 126, 128 and 130 (or more colour stations) supply single colour images to an image being built up on the belt 122. The composite image is then carried on the belt 122 to a final transfer station 130 where it is transferred onto a substrate 132 before going to a fixing station 134. The cleaner 123 cleans the intermediate transfer belt 122 before another image is transferred sequentially onto the intermediate transfer belt 122. Each of the colour imaging stations 124, 126, 128 and 130 operates in a manner as discussed in relation to the embodiments shown in FIGS. 1 to 3 up to the imaging stage 40 (FIG. 1) and then all of the separate colour images are transferred to the belt 122 as the intermediate transfer member. In each printing stage 124, 126, 128 and 130 the imaging roller 41*e*, 41*f*, 41*g* and 41*h* respectively engages against the belt 122. The final transfer station 130 and the fixing station 134 operate in a similar manner to the respective stages 60 and 70 as shown in FIG. 1. At the stage of transfer of the individual colour images from the printing stages 124, 126, 128 and 130 to the belt 122 pressure rollers 124*a*, 126*a*, 128*a* and 130*a* respectively enable an interference fit of the imaging rollers 41*e*, 41*f*, 41*g* and 41*h* onto the image transfer belt 122.

It will be noted that in this embodiment the fixing station 134 includes a UV emission device 136. In this case the ink supplied by the imaging stations 124, 126, 128 and 130 would provide a UV curable ink rather than a heat and pressure curable ink. It should be understood that transfer may be of the electrostatic type, the transfix type, combinations thereof, or other known methods of transferring and fusing toner images.

In FIG. 6 a multi-colour printing apparatus 140 is shown. In this embodiment colour imaging stations 142, 144, 146 and 148 provide developed images onto their respective intermediate transfer members 143, 145, 147 and 149 and the developed image on the intermediate transfer members 143, 145, 147 and 149 are consecutively transferred to a final substrate 150. In this embodiment various colours of the image are built up on the final substrate before a fixing station 152. Also in this embodiment it will be noted that the final substrates are individual sheets of paper 150*a*, 150*b*, 150*c* and 150*d* rather than a continuous web as shown in the earlier embodiments. The sheets of paper are carried on conveyors 154 between the respective final transfer stations and then to the fixing station 152. The paper or other substrate material could be a web of paper or other substrate material.

Each of the colour imaging stations 142, 144, 146 and 148 operates in a manner as discussed in relation to the embodiments shown in FIGS. 1 to 3 up to the final transfer stage 60 (FIG. 1). At the stage of transfer of the individual colour images from the intermediate transfer rollers 143, 145, 147 and 149 to the final substrate 150 pressure rollers 143*a*, 145*a*, 147*a* and 149*a* respectively enable an interference fit of the intermediate transfer rollers 143, 145, 147 and 149 onto the final substrate 150.

Figure 7:
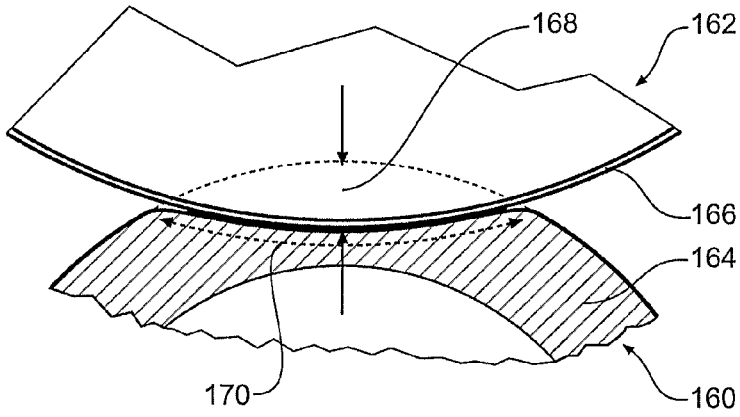
FIG. 7 shows a detailed view of the interference fit between adjacent rollers.

FIG. 7 shows a detail of the interference fit between a development member 160 and an imaging roller 162. The development member 160 has an elastomeric surface 164 while the imaging member 162 has a hard surface with a dielectric or a photoconductor 166 on its surface. When the development member 160 is brought into contact with the imaging roller to give an interference fit as shown by the arrows 168 the yielding surface 164 of the development member is compressed so that the development member 160 remains in contact with the imaging roller for a distance shown by the dotted line and arrows 170. This allows time for transfer of toner particles to the electrostatic image during high speed printing.

At a print speed of 3 $ms^{-1}$, for instance, and for a development time of between 1 and 4 milliseconds, determined by typical mobility values of toner particles, the circumferential length of contact 170 required for achieving complete image development is in the range of 3 to 12 mm. For a wide range of printer system configurations involving rollers of different diameters it is preferable that the interference fit 168 is within the range of 50 to 2000 μm.

Similar interference fits can be provided between the imaging roller and the intermediate transfer roller and in the toner feed stage as discussed above.

Figure 8:
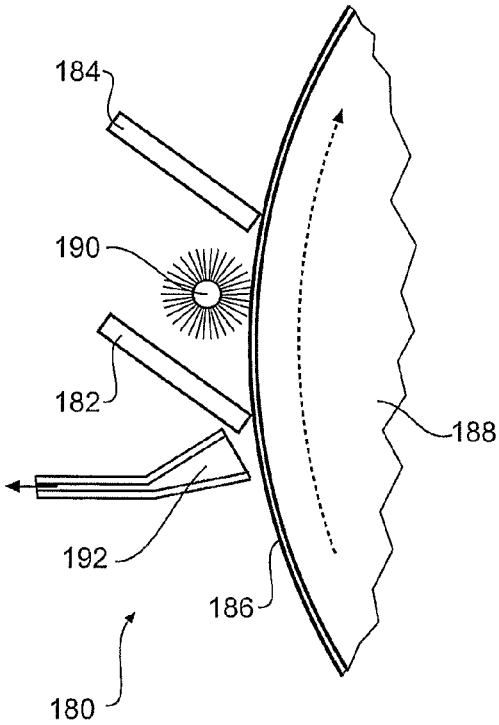
FIG. 8 shows one embodiment of a cleaning system suitable for the image carrying member.

FIG. 8 shows one embodiment for a cleaner unit suitable for an imaging roller or an intermediate transfer roller. The cleaner unit generally shown as 180 comprises two smooth elastomer cleaning blades 182, 184 with one of the edges of each blade polished to a high degree of precision (less than 1 μm) and positioned one after another. These are run against the photoconductor surface 186 of the imaging roller 188.

In one embodiment the elastomer cleaner blades 182 and 184 can be conductive and charged to attract toner residue from the photoconductor.

A cleaning brush roller 190 with very fine bristles may be placed between the cleaning blades 182, 184 to break up toner particle aggregates that may be formed as a result of physical and electrophoretic compaction during development and action of the leading cleaner blade 182. Thickened toner residue collected at the edge of the cleaning blade is removed by use of a vacuum system 192.

Figure 9:
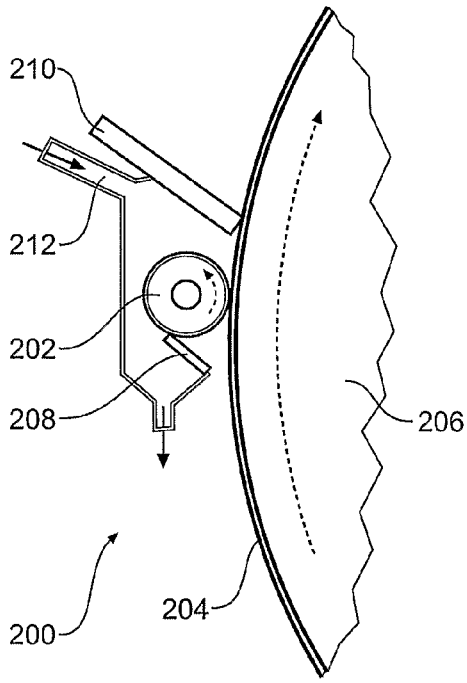
FIG. 9 shows an alternative embodiment of a cleaning system suitable for the intermediate transfer member.

An alternative cleaner system is shown in FIG. 9. The cleaner system in this embodiment is suitable for a development member, an imaging member or an intermediate member. In FIG. 9 the cleaner unit 200 comprises a smooth and polished soft elastomer cleaning roller 202 which is run against the photoconductor surface 204 of the imaging unit 206. The roller 202 is suitably conductive and charged to attract toner residue off the photoconductor 204. This roller is in turn cleaned with a polyurethane blade 208. A further cleaner blade 210 follows the roller 202 and acts directly on the photoconductor 204. This effectively seals the cleaner housing and traps residue for recycling. Each end of the cleaner is sealed off with a closed cell elastomer foam gasket (not shown). The cleaner roller 202 is run either at the same speed or at a differential surface speed to the surface speed of the photoconductor drum. The cleaner roller 202 can co-rotate or counter-rotate to the photoconductor drum 206. Flush fluid may be continuously metered through a flush tube 212 serving a dual function to both lubricate the cleaning roller and blades and dilute the high density residue for ease of recycling. The flush fluid may be the same fluid as the liquid toner carrier fluid.

The cleaning roller 202 may be elastomer coated with polyurethane or NBR or other suitable material. The coating may have a minimum thickness of 3 millimeters and the roller can have a minimum diameter of 20 millimeters. Electrical resistivity of the coating may be in the region of $10^4$ to $10^6$ ohm centimeters.

In an alternative embodiment, the cleaning roller may comprise a very smooth and highly polished metal roller which runs against the surface of the member to be cleaned.

The cleaning roller 202 is charged to such a polarity that creates an electric field between the surfaces of the photoconductor and the cleaning roller, pulling the residue toner off the surface to be cleaned towards the surface of the cleaning roller. The voltage difference may be in the range of 0 to 400 volts. The surface of the roller may be polished to a surface roughness of 1 to 5 μm.

Figure 10:
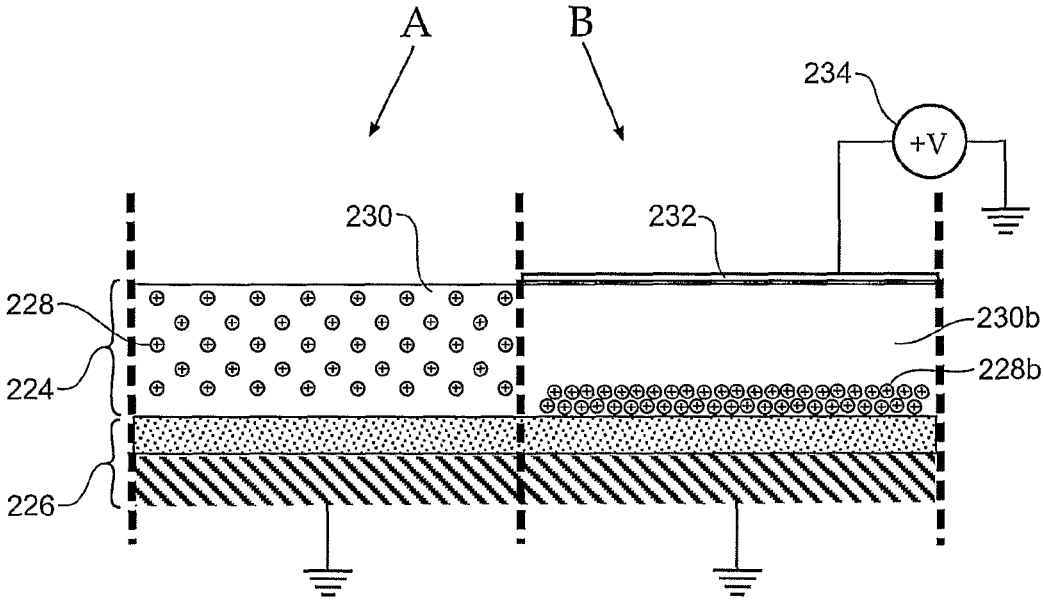
FIG. 10 shows a schematic representation of the operation of a carrier liquid displacement mechanism on a development agent bearing member.

With reference to FIG. 10, an explanation of the carrier liquid displacement of the present invention in diagrammatic form is illustrated. FIG. 10 comprises two sections, section A detailing the state of the marking or toner particles within a liquid toner film or layer prior to the imposition of an electric field through said layer and section B detailing the result of the imposition of an electric field through the liquid toner layer on the marking particles and the generation of a marking particle free carrier liquid layer.

Now, looking at Section A of FIG. 10 in detail, a process (not illustrated) is used to form a film of liquid developing agent 224 on the surface of a developing agent bearing member 226, wherein the liquid developing agent 224 is formed from marking particles 228 dispersed in a dielectric liquid 230. The liquid developing agent having a viscosity of up to 10,000 mPa·s., and a marking particle concentration of up to 60% by weight. Marking particles 228 are illustrated as possessing an inherently positive charge. It would be understood by those skilled in the art that marking particles possessing a negative charge could be utilised in the present invention. The spatial distribution of the marking particles 228 is relatively uniform within the toner 224.

As shown in Section B of FIG. 10, a bias electrode 232 is placed in uniform contact with the liquid developer layer 224. Power supply 234 imposes an electric field through the film of liquid toner 224 on the development agent bearing member 226, thus forming a potential difference through the toner layer, whereby the film of liquid developing agent splits into two spatially separated layers; one layer comprising of an increased concentration of marking particles 228*b* compacted close to the development agent bearing member 226, and a second layer of carrier fluid 230*b* positioned above the compacted toner layer, and substantially free from marking particles 228*b*.

It would be understood by those skilled in the art that, where toners possessing a negative charge are utilised in the present invention, the imposition of a negative voltage on the bias electrode 232 can be used.

A method of determining the charge on the marking particles, and therefore assisting in readily determining the voltage and time that would be required to generate the two spatially separated layers, is described in commonly assigned U.S. Pat. No. 6,613,209 to Ozerov, the entire disclosure of which is incorporated by reference herein.

It should be understood that bias electrode 232 can take various forms. For example, a roller connected to power supply 234 could be placed on the toner layer to generate the two spatially separated layers. Alternatively, a bias electrode could be connected to power supply 234, and in which the development bearing member 226 with the liquid developer layer is passed under the electrode and thereby generating the two spatially separated layers. As a further alternative, the bias electrode 232 could comprise a blade or the like. In yet a further alternative a discharge device such as a corotron or scorotron could be used to form a potential difference through the liquid toner layer. That is, a substantially uniform charge is placed on the surface of the liquid toner film to thereby generate the two spatially separated layers.

Figure 11:
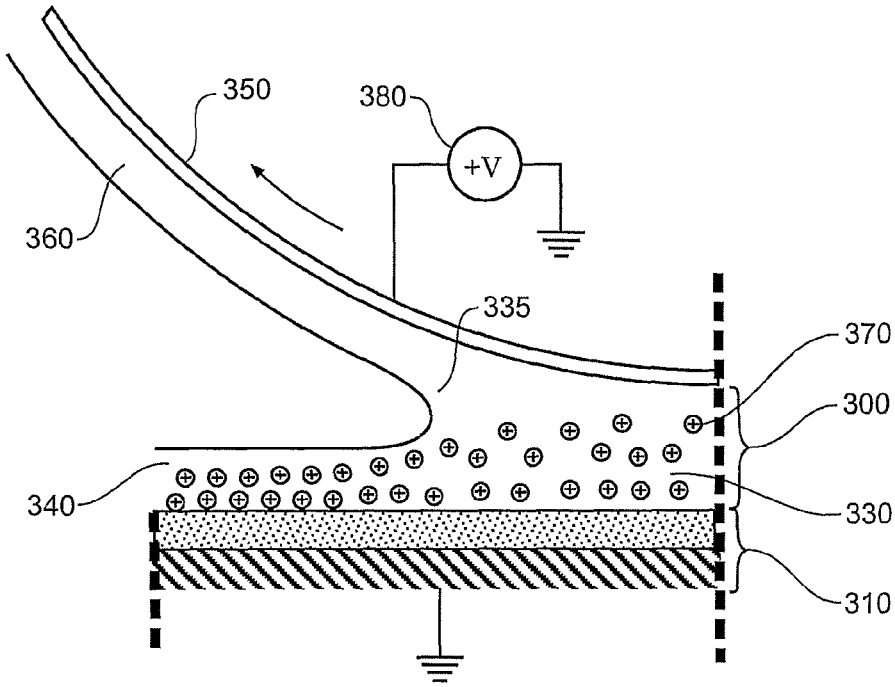
FIG. 11 shows a schematic representation of the operation of a carrier liquid displacement mechanism on an image bearing member.

With reference now to FIG. 11, an explanation of the carrier liquid displacement, or in this illustrative case in which the carrier liquid displacement device is acting on a developed image, is illustrated in diagrammatic form.

In FIG. 11, a developed toner image 300 is carried around on the surface of an intermediate transfer roller, belt or an imaging roller 310, passes under a carrier liquid displacement roller 350. The carrier liquid displacement roller 350 has a voltage V impressed upon it by voltage supply 380. This acts to push the marking particles 370 of the toner image down to the surface of intermediate transfer roller, belt or imaging roller 310 so that further liquid displacement occurs before the toner image is transferred to a substrate stage (not shown). Carrier liquid 330 trapped between the marking particles 370 of the developed image 300 is substantially removed. At the same time a layer, or possibly a further layer depending at which step in the process the carrier liquid displacement is occurring, of carrier liquid 335 is formed outside the toner layer as discussed in relation to FIG. 10. The toner carrier liquid displacement roller 350 also acts to remove this excess carrier liquid from the layer of carrier liquid 335, and leaving only a very small amount of carrier liquid 340. The excess liquid 360 is scraped off the roller 350 by a scraper (not shown) and can be recycled.

To assist with the transfer of the toner particles at the various stages, each of the rollers may have a voltage impressed upon it as shown schematically in FIGS. 1 to 3.

In standard conditions, the voltage on the supply roller 13 ($V_{FR}$) may be the same as the voltage on the pick-up roller 16 ($V_{PR1}$), the metering roller 21 ($V_{PR2}$) and the development member 31 ($V_{DR}$). In one preferred embodiment, the voltage $V_{IR}$ applied to the imaging roller 41 is equal to zero; which provides the current path during the formation of the latent electrostatic image on the surface of the imaging roller, toner development, and transfer from the surface of the imaging roller. In one preferred embodiment, the voltage on each of the first four rollers is in the range of +50 to 800 volts and the voltage on the surface of the imaging roller is a maximum of 1000 volts.

A voltage ($V_{TC1}$) is placed on carrier liquid displacement roller 33*c* in FIG. 3, and a voltage ($V_{TC2}$) is placed on carrier liquid displacement roller 35 in FIG. 3. Both these voltages should be higher than that applied to the roller upon which it bears to give an effect of driving toner particles towards the respective development and imaging rollers.

A voltage ($V_{TR}$) is placed onto the intermediate transfer roller 51 to attract the developed image to that roller and a voltage ($V_P$) is provided on the pressure roller 62 to assist with transfer of toner particles to the substrate 61.

A further voltage ($V_{CL}$) is placed onto the cleaner roller 81 to remove any final toner particles from the intermediate transfer roller before a new image is placed thereon.

Figure 12:
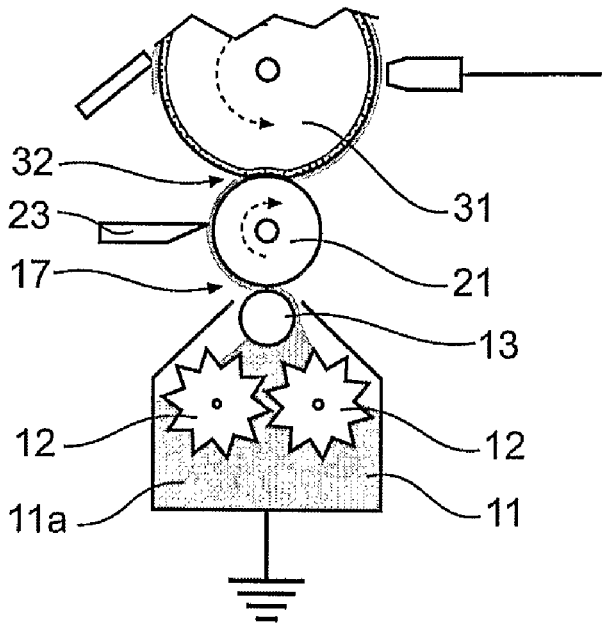
FIG. 12 shows detail of an alternative toner supply mechanism before the development member.

FIG. 12 is an alternative embodiment of the toner supply portion of the present invention. In FIG. 12, the schematic electrostatic printing process is generally as described in FIG. 1 and the same reference numerals are used for corresponding items.

In the toner supply stage 10 a toner tank 11 has counter rotating gear wheels 12 which extend into toner 11*a* in the tank 11 and provide a supply of high viscosity toner to a supply roller 13. The supply roller extends out of the top of the toner tank 11 and is spaced apart from a metering roller 21 by a gap 17 which is in the range of from 50 to 400 μm. This produces a layer of toner on the metering roller of at least 50 μm. The toner supply stage may comprise other forms or methods of supplying, pumping or otherwise moving the toner from toner tank 11 to metering roller 21.

The metering roller 21 has a pattern of recesses on its surface and a doctor blade 23 bearing against the metering roller 21 scrapes essentially all of the high viscosity toner off the metering roller 21 except that toner which is within the recesses in the pattern of recesses on the metering roller 21. The metering roller preferably has a trihelical pattern with a resolution of 200 lines per inch with a normal pattern depth of 30 μm.

The metering roller 21 bears against a development member 31 with an interference fit 32 which is within the range of 50 to 2000 μm. The interference fit is made possible because although the surface of the metering roller 21 is relatively hard, the surface of the development member 31 is relatively soft and the metering roller 21 pushes into the development member 31. The interference fit provides a contact time during the rotation of each roller during which toner may be transferred from the metering roller 21 to the development member 31. The thickness of toner on the development member 31 after it has been transferred from the metering roller 21 is in the range of from 1 to 40 μm.

Subsequent steps in the operation of the electrostatic printing process are as described in relation to FIG. 1.

Figure 13:
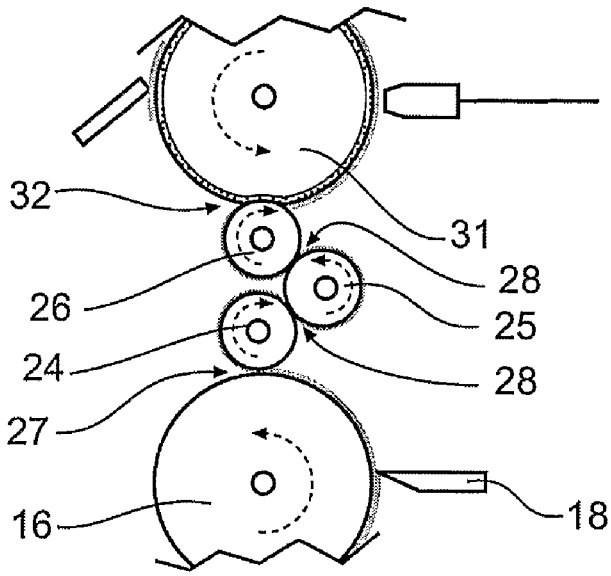
FIG. 13 shows detail of a further alternative toner supply mechanism.

FIG. 13 is an alternative embodiment of the toner supply portion of the present invention. In FIG. 13, the schematic electrostatic printing process is generally as described in FIG. 1 and the same reference numerals are used for corresponding items.

The toner supply stage is as discussed in relation to FIG. 1 up to the pick-up roller 16. The pick-up roller 16 has a doctor blade 18 bearing against it to provide an even thin layer of high viscosity toner onto the pick-up roller 16.

The pick-up roller 16 in this embodiment can be in "kiss" contact or with an interference fit against a multi roller feed train of at least three or more smooth rollers. In this embodiment there are three smooth rollers 24, 25 and 26. The train of smooth rollers produce a thin layer (1 to 40 μm) of toner for transfer to the development member. The pick-up roller 16 is in "kiss" contact with the first smooth roller 24. Each of the smooth rollers 24, 25 and 26 are in "kiss" contact or with an interference fit with each other. The interference fit between the three smooth rollers can be up to 1,000 μm. The degree of interference will determine the thickness of the toner layer that is presented to the development member 31. The feed rollers 24, 25 and 26 may comprise elastomer rollers coated with polyurethane or NBR or other suitable material. The electrical resistivity of the coating may be in the region of $10^4$ to $10^8$ ohm centimeters.

The final smooth roller 26 bears against a development member 31 with an interference fit 32 which is up to 1000 μm. The interference fit is made possible because although the surface of the final smooth roller 26 is relatively hard, the surface of the development member 31 is relatively soft and the final smooth roller 26 pushes into the development member 31. The interference fit provides a contact time during the rotation of each roller during which toner may be transferred from the final smooth roller 26 to the development member 31. The thickness of toner on the development member 31 after it has been transferred from the final smooth roller 26 is in the range of from 1 to 40 μm.

Subsequent steps in the operation of the electrostatic printing process are as described in relation to FIG. 1.

Figure 14:
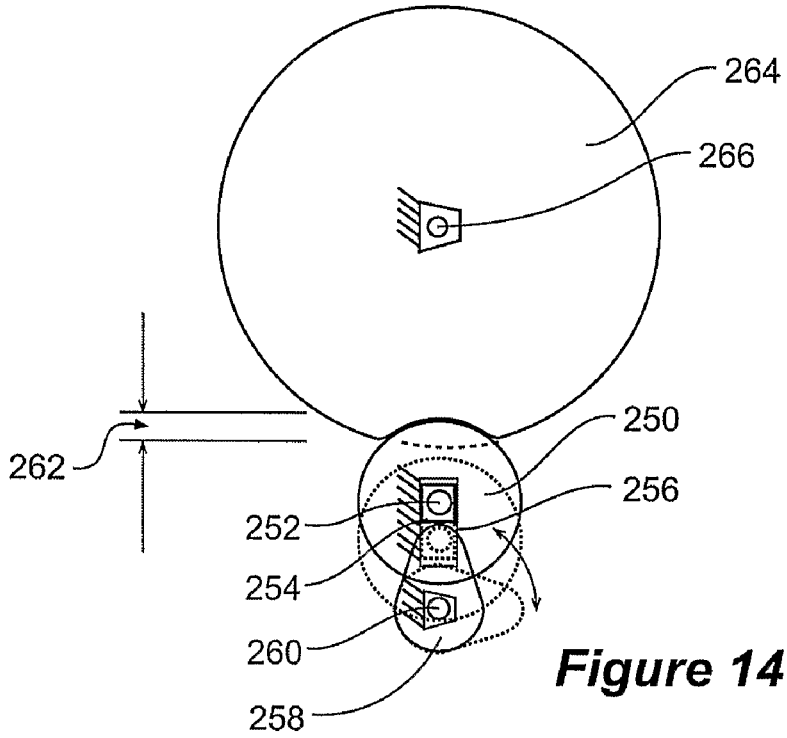
FIG. 14 shows detail of a mechanism for setting the interference fit between the metering roller and the development member according to the present invention.

FIG. 14 shows detail of a mechanism for setting the interference fit between the metering roller and the development member according to the present invention. In this embodiment a metering roller 250 rotates on a shaft 252 which is carried in a bearing block 254 which travels in a slot 256 in a chassis of the printing machine. A cam 258 rotating on a shaft 260 engages the bearing block 254 and thereby pushes the metering roller into an interference fit 262 into the development member 264 which rotates on shaft 266. By this arrangement the interference fit can be set by rotation of the cam 258.

Figure 15:
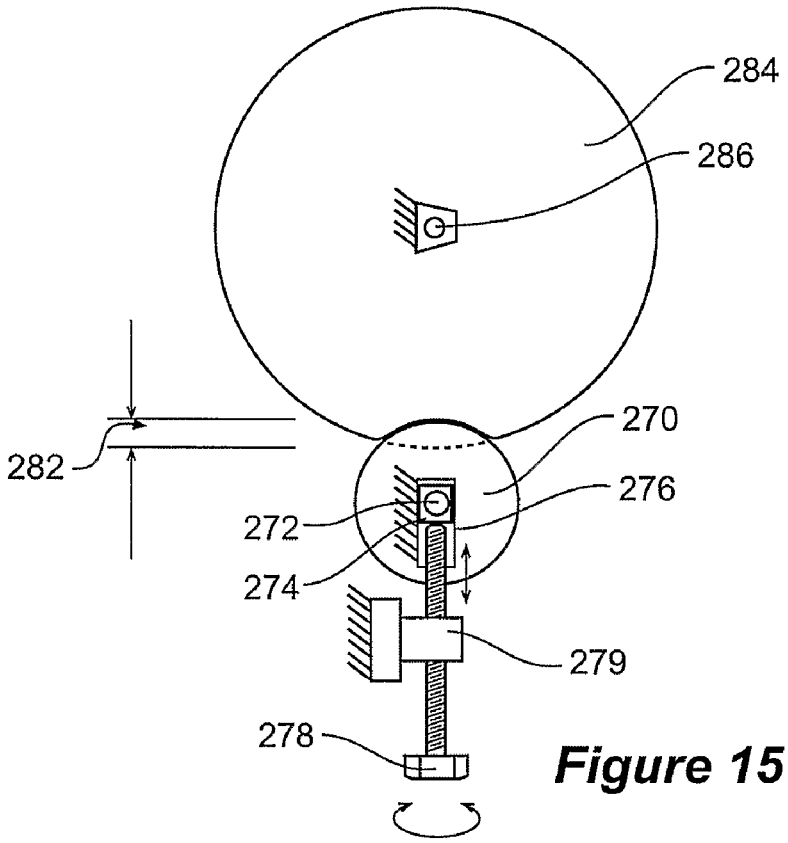
FIG. 15 shows detail of an alternative mechanism for setting the interference fit between the metering roller and the development member according to the present invention.

FIG. 15 shows detail of an alternative mechanism for setting the interference fit between the metering roller and the development member according to the present invention. In this embodiment a metering roller 270 rotates on a shaft 272 which is carried in a bearing block 274 which travels in a slot 276 in a chassis of the printing machine. A set screw 278 extending through a threaded block 279 engages the bearing block 274 and thereby pushes the metering roller into an interference fit 282 into the development member 284 which rotates on shaft 286. By this arrangement the amount of interference fit of the metering roller into the development member can be varied and set by screwing in or out the set screw.

The mechanisms shown in FIGS. 14 and 15 can also be used to set the interference fit between the development member and the imaging member and between the imaging member and the intermediate transfer roller.

In one preferred embodiment of the invention, the voltages applied to the various rollers are as follows:

| | |
|---|---|
| $V_{FR}$ | +50 to +800 volts |
| $V_{PR1}$ | +50 to +800 volts |
| $V_{PR2}$ | +50 to +800 volts |
| $V_{DR}$ | +50 to +800 volts |
| $V_{IR}$ | 0 volts |
| $V_{TR}$ | −50 to −2000 volts |
| $V_P$ | −500 to −2500 volts |
| $V_{TC1\ (development\ stage)}$ | +50 to +1500 volts |
| $V_{TC2\ (imaging\ stage)}$ | +50 to +600 volts |

-continued

| | |
|---|---|
| $V_{TC3\ (intermediate\ stage)}$ | +50 to +1000 volts |
| $V_{CL}$ | −50 to −2500 volts |

It has been found that rollers can be of a selected size for more efficient operation. In one of the preferred embodiments, it has been found that, if the image carrying member has a diameter of 1.0 unit, the development member should have a preferred diameter of 0.1 to 1.0 units, more preferably 0.3 units; the metering roller should have a preferred diameter of 0.1 to 0.5 units, more preferably 0.2 units; the pick-up roller should have a preferred diameter of 0.1 to 0.5 units, more preferably 0.4 units; and the supply roller should have a preferred diameter of 0.1 to 0.3 units, more preferably 0.1 units.

Some of the reasons for choosing roller diameters of a selected size are as follows.

Imaging Carrying Member (Photoconductor) Diameter

In the high-speed printing process, based on electrophotographic development principles, it is very important to provide sufficient time for the photoconductor to acquire a charge as a result of the roller, corona or corotron charging process, and to also dissipate charge after exposure. To meet these requirements, minimum circumferential distances between the charging device and the imaging device, and between the imaging device and the development nip need to be maintained. The higher the printing speed, the larger the circumferential separation between these charging, exposure and development areas needs to be to meet the time requirement for a given photoconductor. This is achieved by having a greater diameter roller. A second point is the importance of the type of photoconductor material in selecting a diameter. This determines the rate of charge dissipation after exposure. Alpha-Si, for example, has the highest discharge rate and therefore the photoconductor diameter could be reduced to still satisfy the discharge time requirements. Alpha-Si is a preferred embodiment of the present invention for the photoconductor. Knowing the photoconductor discharge rate (less than 20 ms), it can be determined that the minimum circumferential distance between the exposure location and the development nip at a surface rotation speed of 1.5 $ms^{-1}$ would be approximately 30 mm. In selecting the imaging roller diameter, for one of the preferred embodiments of the present invention, consideration was given to the diameter values that are widely available commercially.

Development Member Diameter

Toner particles, even in high viscosity toning applications with virtually zero development gap, would need some time to deposit fully onto an imaging roller. It is estimated that this minimum time is 1-3 ms, and is dependent on toner mobility, development bias, photoconductor residual charge, toner layer thickness and development member properties. To print at 3 $ms^{-1}$, for instance, the development nip width should be in excess of 3 mm. For a 242 mm imaging roller diameter and a development member of approximately 40 Shore A hardness, a development member diameter of approximately 80 mm is needed to attain the required development nip width.

Other Rollers

The various rollers in the toner feed train, the supply roller, the pick-up roller and the metering roller can all have small diameters, commensurate with their function so that as small a toner feed system as possible can be provided. Likewise, other rollers, such as the carrier liquid displacement and cleaning rollers can be of a diameter commensurate with their function, as would be understood by those practised in the art.

In one of the preferred embodiments, the preferred diameter of the various rollers is as follows:

| Roller | Ratio | Preferred Ratio | Preferred Diameter (mm) |
|---|---|---|---|
| Image Carrying | 1.0 | 1.0 | 200 |
| Development | 0.1-1.0 | 0.3 | 60 |
| Metering | 0.1-0.5 | 0.2 | 40 |
| Pick-up | 0.1-0.5 | 0.4 | 80 |
| Toner Supply | 0.1-0.3 | 0.1 | 20 |

In a preferred embodiment of the present invention the development member may have the following preferable characteristics:

| Development member | Range | Preferred |
|---|---|---|
| Roughness | Rz ≦ 2 μm | Rz ≦ 2 μm |
| Hardness of coating | 40-60° Shore A | 50° Shore A |
| Surface energy | 30-40 mN/m | 35 mN/m |
| Electrical resistivity | $1 \times 10^4$-$1 \cdot 10^8$ Ω · cm | $1 \times 10^6$ Ω · cm |

In a preferred embodiment of the present invention, the intermediate transfer member may be a roller or belt, and may have the following preferable characteristics:

| Intermediate Member | Range | Preferred |
|---|---|---|
| Roughness | Rz ≦ 2 μm | Rz ≦ 2 μm |
| Hardness of coating | 40-70° Shore A | 60° Shore A |
| Surface energy | 20-40 mN/m | 30 mN/m |
| Electrical resistivity | $1 \times 10^4$-$1 \cdot 10^8$ Ω · cm | $1 \times 10^7$ Ω · cm |

In order to achieve good cleaning and release properties, rollers may have additional over coatings. The preferred materials to be used for overcoating are polyurethane and fluorinated rubbers (silicone rubbers could be used also).

A high viscosity, high concentration toner suitable for use with the present invention may have a formulation as follows:

| | |
|---|---|
| Colour Pigment | 2-30% |
| Fixing Resin | 8-30% |
| Charge Control Agent | 0-5% |
| Dispersing Agent | 0-10% |
| Carrier liquid | 40-90% |
| Solid Content | 1-60% |

The carrier liquid may comprise any suitable liquids as is known in the art, and may include silicone fluids, hydrocarbon liquids and vegetable oils, or any combinations thereof.

The present invention solves the herein described prior art and other problems, thereby advancing the state of the useful arts, by providing a method of developing an electrostatic latent image with highly viscous, highly concentrated liquid toners at high speed.

All measurements herein were taken at room temperature (25° C.). Viscosities were measured using a HAAKE Rheo-Stress RS600.

It can be appreciated that changes to any of the above embodiments can be made without departing from the scope of the present invention as defined by the claims and that other variations of the specific construction disclosed herein can be made by those skilled in the art without departing from the invention.

The invention claimed is:

1. An electrostatic printing machine adapted for high speed printing comprising;

(a) a toner supply device to supply to a toner supply roller a high viscosity highly concentrated liquid toner;

(b) a metering roller which receives a thin layer of the liquid toner from the toner supply roller;

(c) a development member;

(d) the metering roller bearing against the development member with an interference fit to transfer a thin layer of the liquid toner onto the development member;

(e) a carrier liquid displacement device to act upon the thin layer of liquid toner on the development member to push toner particles in the thin layer towards the surface of the roller and to leave a carrier liquid rich layer on the outside of the thin toner layer;

(f) an image forming stage, the image forming stage comprising an image carrying member having a surface adapted to retain an electrostatic latent image thereon;

(g) the development member engaging against the image carrying member with an interference fit to give a selected contact time therebetween;

(h) a development stage in which liquid toner particles in the thin layer on the development member are transferred to the image carrying member under the influence of the electrostatic latent image on the image carrying member to provide a developed image thereon;

(i) an intermediate transfer stage in which the developed image is transferred from the image carrying member to an intermediate transfer member, with an interference fit between the image carrying member and the intermediate transfer member to give a selected contact time therebetween; and (j) a transfer stage in which the developed image is transferred from the intermediate transfer member onto a substrate; wherein the interference fit of the development member against the image carrying member is from 50 to 2000 μm and the interference fit of the metering roller against the development member is from 50 to 2000 μm;

(k) wherein the metering roller comprises a pattern of recesses thereon and further including a doctor blade bearing against the metering roller.

2. An electrostatic printing machine as in claim 1 further including a pick-up roller between the toner supply roller and the metering roller and which is spaced from the supply roller by a first feed gap and spaced from the metering roller by a second feed gap.

3. An electrostatic printing machine as in claim 2 wherein the first feed gap between the toner supply roller and the pick-up roller is from 100 to 500 μm.

4. An electrostatic printing machine as in claim 2 wherein the second feed gap between the pick-up roller and the metering roller is from 50 to 400 μm.

5. An electrostatic printing machine as in claim 2 comprising a doctor blade bearing against the pick-up roller to provide a layer of the high viscosity liquid toner on the pick-up roller of from 100 to 2000 μm thick.

6. An electrostatic printing machine as in claim 2 wherein the imaging member and the development member are rollers and the ratios range of the diameters of respective rollers with respect to the image carrying member are as follows;

| | |
|---|---|
| development member | 0.1-1.0 |
| the metering roller | 0.1-0.5 |
| the pick-up roller | 0.1-0.5 |
| toner supply roller | 0.1-0.3. |

7. An electrostatic printing machine as in claim 2 wherein the imaging member and the development member are rollers and the ratios of the diameters of respective rollers with respect to the image carrying member are as follows;

| | |
|---|---|
| development member | 0.3 |
| the metering roller | 0.2 |
| the pick-up roller | 0.4 |
| toner supply roller | 0.1. |

8. An electrostatic printing machine as in claim 1 wherein the image forming stage comprises an image carrying member having a surface adapted to retain a electrostatic charge thereon, a charging device to provide a uniform electrostatic charge to the surface and a discharge device to selectively discharge the uniform electrostatic charge to form the electrostatic latent image thereon.

9. An electrostatic printing machine as in claim 8 wherein the surface of the image carrying member comprises a photoconductor and the discharge device comprises an illumination device.

10. An electrostatic printing machine as in claim 1 wherein the image forming stage comprises an image carrying member having a dielectric surface adapted to retain an electrostatic charge thereon and a selective charging device to provide a selected electrostatic charge to the surface to form the electrostatic latent image thereon.

11. An electrostatic printing machine as in claim 1 wherein the toner supply comprises a pair of counter rotating gears feeding the high viscosity liquid toner to the toner supply roller.

12. An electrostatic printing machine as in claim 1 wherein the metering roller comprises an Anilox roller.

13. An electrostatic printing machine as in claim 1 wherein the development member is held at an electrical potential of from +50 to +800 volts.

14. An electrostatic printing machine as in claim 1 wherein the carrier liquid displacement device comprises a corona discharge device.

15. An electrostatic printing machine as in claim 1 wherein the carrier liquid displacement device comprises a carrier liquid displacement roller bearing against the development member and having a voltage applied to it of from +50 to +1500 volts.

16. An electrostatic printing machine as in claim 15 wherein the carrier liquid displacement roller bearing against the development member is adapted to remove excess carrier from the carrier rich layer.

17. An electrostatic printing machine as in claim 1 wherein the electrostatic image on the image carrying member has image regions at a potential of from +200 to +900 volts and non-image regions at a potential of from +0 to +150 volts.

18. An electrostatic printing machine as in claim 1 wherein the interference fit of the image carrying member against the intermediate transfer member is from 50 to 2000 μm.

19. An electrostatic printing machine as in claim 1 further comprising a set screw arrangement or a cam mechanism engaging a shaft of the metering roller to engage the metering roller against the development member to set the amount of the interference fit.

20. An electrostatic printing machine as in claim 1 further comprising a carrier liquid displacement device to act upon the developed image of liquid toner on the intermediate transfer member to push toner particles in the thin layer towards the surface of the intermediate transfer member.

21. An electrostatic printing machine as in claim 20 wherein the carrier liquid displacement device comprises a corona discharge device.

22. An electrostatic printing machine as in claim 20 wherein the carrier liquid displacement device comprises a carrier liquid displacement roller bearing against the intermediate transfer member and having a voltage applied to it of from +50 to +1500 volts.

23. An electrostatic printing machine as in claim 22 wherein the carrier liquid displacement roller bearing against the development member is adapted to remove excess carrier from the carrier rich layer.

24. An electrostatic printing machine as in claim 1 wherein the intermediate transfer member is held at an electrical potential of from −50 to −2000 volts.

25. An electrostatic printing machine as in claim 1 further comprising an erasing stage in which any remaining electrostatic image on the image carrying member is erased after the developed image is transferred from the image carrying member.

26. An electrostatic printing machine as in claim 1 further comprising a cleaner stage in which any unused toner on the image carrying member after the transfer to the final transfer stage is cleaned off the image carrying member.

27. An electrostatic printing machine as in claim 26 wherein the cleaner stage comprises a cleaning brush roller and a smooth elastomer cleaning blade each side of the brush roller engaged against the image carrying member.

28. An electrostatic printing machine as in claim 26 wherein the cleaner stage comprises a cleaning roller and a smooth elastomer cleaning blade engaged against the image carrying member.

29. An electrostatic printing machine as in claim 28 wherein the cleaning roller comprises a roller selected from the group comprising an elastomer coated roller or a highly polished metal roller.

30. An electrostatic printing machine as in claim 28 wherein the cleaner stage further comprises a flush fluid supply to lubricate the cleaning roller and cleaning blade and to dilute cleaner residue for recycling.

31. An electrostatic printing machine as in claim 1 further comprising an image fixing stage in which the image on the substrate is fixed.

32. An electrostatic printing machine as in claim 31 wherein the image fixing stage uses heat and compression between rollers.

33. An electrostatic printing machine as in claim 31 wherein the image fixing stage uses image fixing by a process selected from the group comprising UV curing, EB curing, heat curing or heat and compression curing.

34. An electrostatic printing machine as in claim 1 wherein the development member, the pick-up roller, the metering roller and the toner supply roller are held at the same voltage relative to each other.

35. An electrostatic printing machine as in claim 1 wherein the image carrying member is a drum with a photoconductive surface selected from the group comprising alpha-silicon, organic photoconductor or $As_2Se_3$.

36. An electrostatic printing machine as in claim 1 wherein the development member is selected from the group comprising a roller or a belt.

37. An electrostatic printing machine as in claim 1 further comprising a pressure roller behind the substrate at the final transfer stage.

38. An electrostatic printing machine as in claim 1 wherein the substrate is selected from the group comprising sheet fed paper or a continuous web.

39. An electrostatic printing machine as in claim 1 wherein the metering roller comprises a surface selected from the group comprising a random pattern, a trihelical or Z-channel.

40. An electrostatic printing machine as in claim 1 wherein the liquid toner is formed by dispersing marking particles in a dielectric liquid such that the liquid developing agent has a viscosity of from 10 mPa·s up to 10,000 mPa·s.

41. An electrostatic printing machine as in claim 1 wherein the thin layer of the toner transferred onto the development member has a thickness of from 1 to 40 μm.

42. An electrostatic printing machine as in claim 1 further including a feeder roller between the metering roller and the development member, the feeder roller being driven to rotate at a speed which is different to the speed of the development member.

43. An electrostatic printing machine as in claim 1 wherein the metering roller comprises a train of smooth rollers to produce a thin layer of toner for transfer to the development member.

44. An electrostatic printing machine as in claim 1 wherein the metering roller comprises a surface having a line resolution of from 150 to 250 lines per inch and a pattern depth of from 20 to 30 μm.

45. An electrostatic printing machine as in claim 1 wherein the metering roller comprises an Anilox roller with a trihelical surface pattern configuration, a resolution of 200 lines per inch and a pattern depth of 30 μm.

46. An electrostatic printing machine as in claim 1 wherein the liquid toner is formed by dispersing marking particles in a dielectric liquid such that the liquid developing agent has a viscosity of from 10 to 5,000 mPa·s.

47. An electrostatic printing machine as in claim 1 wherein the liquid toner is formed by dispersing marking particles in a dielectric liquid such that the liquid developing agent has a viscosity of from 20 to 1,000 mPa·s.

48. An electrostatic printing machine as in claim 1 further comprising a cleaner stage in which any unused toner on the intermediate transfer member after the transfer to the final transfer stage is cleaned off the intermediate transfer member.

49. An electrostatic printing machine as in claim 48 wherein the cleaner stage comprises a cleaning brush roller and a smooth elastomer cleaning blade each side of the brush roller engaged against the intermediate transfer member.

50. A high speed electrostatic printing machine comprising;

(a) a toner supply to supply to a toner supply roller a high viscosity highly concentrated liquid toner;

(b) a pick-up roller which is spaced from the supply roller by a first feed gap, wherein the first feed gap between the toner supply roller and the pick-up roller is from 100 to 500 μm;

(c) a metering roller which receives a thin layer of the toner from the pick-up roller, wherein a second feed gap between the pick-up roller and the metering roller is from 50 to 400 μm;

(d) the metering roller having a pattern of recesses thereon;

(e) a doctor blade bearing against the metering roller;

(f) a development member;

(g) the metering roller bearing against the development member with an interference fit to transfer a thin layer of the liquid toner onto the development member, wherein the interference fit of the metering roller against the development member is from 50 to 2000 μm;

(h) a carrier liquid displacement device to act upon the thin layer of liquid toner on the development member to push toner particles in the thin layer towards the surface of the roller and to leave a carrier liquid rich layer on the outside of the thin toner layer;

(i) an image forming stage, the image forming stage comprising an image carrying member having a surface adapted to retain an electrostatic latent image thereon;(j) the development member engaging against the image carrying member with an interference fit to give a selected contact time therebetween;

(k) a development stage in which toner particles in the thin layer on the development member are transferred to the image carrying member under the influence of the electrostatic latent image on the image carrying member to provide a developed image thereon;

(l) an intermediate transfer stage in which the developed image is transferred from the image carrying member to an intermediate transfer member with an interference fit between the image carrying member and the intermediate transfer member to give a selected contact time therebetween; wherein the interference fit of the image carrying member against the intermediate transfer member is from 50 to 2000 μm; and (m) a transfer stage in which the developed image is transferred from the intermediate transfer member onto a substrate.

51. An electrostatic printing machine as in claim 50 further comprising a cleaner stage in which any unused toner on the intermediate transfer member after the transfer to the transfer stage is cleaned off the intermediate transfer member.

52. An electrostatic printing machine as in claim 51 wherein the cleaner stage comprises a cleaning brush roller and a smooth elastomer cleaning blade each side of the brush roller engaged against the image carrying member or the intermediate transfer member.

53. An electrostatic printing machine as in claim 51 wherein the cleaner stage comprises a cleaning roller and a smooth elastomer cleaning blade engaged against the image carrying member or the intermediate transfer member.

54. An electrostatic printing machine as in claim 53 wherein the cleaning roller comprises a roller selected from the group comprising an elastomer coated roller or a highly polished metal roller.

55. An electrostatic printing machine as in claim 53 wherein the cleaner stage further comprises a flush fluid supply to lubricate the cleaning roller and cleaning blade and to dilute cleaner residue for recycling.

56. A high speed electrostatic printing machine comprising;

(a) a toner supply to supply to a supply roller a high viscosity liquid toner having a concentration of chargeable particles of up to 60% by weight in a non-conductive carrier liquid;

(b) a pick-up roller which is spaced from the supply roller;

(c) a first feed gap between the toner supply roller and the pick-up roller of from 100 to 500 μm;

(d) a metering roller which receives a layer of the liquid toner from the pick-up roller;

(e) a second feed gap between the pick-up roller and the metering roller of from 50 to 400 μm;

(f) the metering roller having a pattern of recesses thereon;

(g) a doctor blade bearing against the metering roller;

(h) a feeder roller which receives a layer of the toner from the metering roller;

(i) the metering roller bearing against the feeder roller with an interference fit;

(j) a development member;

(k) the feeder roller bearing against the development member with an interference fit to transfer a thin layer of the liquid toner onto the development member;

(l) an image forming stage, the image forming stage comprising an image carrying member having a surface adapted to retain an electrostatic charge thereon, a charging device to provide a uniform electrostatic charge to the surface and a discharge device to selectively discharge the uniform electrostatic charge to form an electrostatic image thereon;

(m) the development member engaging against the image carrying member with an interference fit to give a selected contact time;

(n) a development stage in which toner particles in the thin layer on the development member are transferred to the image carrying member under the influence of the electrostatic image on the image carrying member to provide a developed image thereon; and (o) a transfer stage in which the developed image is transferred from the image carrying member onto a substrate, or a further member, such as an intermediate member.

* * * * *